US006787296B2

(12) United States Patent
Ren et al.

(10) Patent No.: US 6,787,296 B2
(45) Date of Patent: Sep. 7, 2004

(54) SILVER HALIDE EMULSION AND SILVER HALIDE PHOTOGRAPHIC MATERIAL BY THE USE THEREOF

(75) Inventors: Rieko Ren, Tokyo (JP); Tomoyuki Nakayama, Tokyo (JP)

(73) Assignee: Konica Corporation, Tokyo (JP)

( * ) Notice: Subject to any disclaimer, the term of this patent is extended or adjusted under 35 U.S.C. 154(b) by 171 days.

(21) Appl. No.: 10/151,533

(22) Filed: May 20, 2002

(65) Prior Publication Data

US 2003/0096202 A1 May 22, 2003

(30) Foreign Application Priority Data

May 29, 2001 (JP) ..... 2001-160371

(51) Int. Cl.[7] ..... G03C 1/08; G03C 7/26; G03C 7/32

(52) U.S. Cl. ..... 430/558; 430/567; 430/599; 430/569; 430/604; 430/605

(58) Field of Search ..... 430/558, 567, 430/569, 599, 604, 605

(56) References Cited

U.S. PATENT DOCUMENTS 5,906,914 A * 5/1999 Taguchi et al. ..... 430/567
6,245,498 B1 * 6/2001 Suzuki et al. ..... 430/567
6,432,626 B1 * 8/2002 Sugimoto et al. ..... 430/567
6,558,891 B2 * 5/2003 Takada et al. ..... 430/567

FOREIGN PATENT DOCUMENTS

| | | |
|---|---|---|
| JP | 58-111935 | 4/1983 |
| JP | 58-111936 | 4/1983 |
| JP | 58-111937 | 4/1983 |
| JP | 58-113927 | 7/1983 |
| JP | 59-99433 | 8/1984 |
| JP | 7-209785 | 11/1995 |
| JP | 08-62754 | 8/1996 |

* cited by examiner

*Primary Examiner*—Geraldine Letscher
(74) *Attorney, Agent, or Firm*—Frishauf, Holtz, Goodman & Chick, P.C.

(57) ABSTRACT

Silver halide emulsions are disclosed comprising tabular silver halide grains containing dislocation lines in the peripheral region of the major faces; the tabular grains comprising a high iodide phase which is internal to and along the dislocation lines and an internal region which is surrounded by the high iodide phase and comprised of substantially homogeneous silver halide phase and having an average iodide content of not more than 1 mol %. Silver halide photographic materials by the use of the emulsion are also disclosed.

56 Claims, 2 Drawing Sheets

SILVER HALIDE EMULSION AND SILVER HALIDE PHOTOGRAPHIC MATERIAL BY THE USE THEREOF

FIELD OF THE INVENTION

The present invention relates to a silver halide emulsion exhibiting a relatively high contrast, improved in process stability and forced developability even when coated in a multiplayer structure, and a silver halide photographic material and a silver halide color photographic material by the use thereof.

BACKGROUND OF THE INVENTION

Recently, the demand for improvements in photographic silver halide emulsions has become pronounced, and further, requirements have also been demanded for higher level photographic performance including higher speed, superior graininess and improved pressure resistance.

Methods for enhancing sensitivity of a silver halide emulsion, specifically for enhancing quantum sensitivity include, for example, the use of tabular silver halide grains, as described in U.S. Pat. Nos. 4,434,226, 4,439,520, 4,414,310, 4,433,048, 4,414,306, and 4,459,353; JP-A Nos. 58-111935, 58-111936, 58-111937, 58-113927 and 59-99433 (hereinafter, the term, JP-A means an examined and published Japanese Patent Application). Further, JP-A No. 63-220238 discloses as a means for achieving enhanced sensitivity, a technique for introducing dislocation lines into the interior of silver halide grains.

On the other hand, the trend for enhancing image quality is remarkable and the desire for enhanced sensitivity at a smaller grain size has increased year by year to achieve enhanced graininess of silver halide grains. The foregoing techniques of tabular grains and dislocation lines are effective means for achieving enhancement of sensitivity of smaller silver halide grains. In cases when dislocation lines are applied to tabular grains of a high aspect ratio to exploit characteristics of tabular grains, however, sufficient sensitization could not necessarily be effected for smaller silver halide grains. Furthermore, deteriorations in photographic performance such as tone characteristic or process stability was caused, resulting in a decrease in contrast and making it insufficient to understand design factors for the grain structure.

JP-A No. 8-62754 disclosed small silver halide grains having dislocation lines and exhibiting enhanced sensitivity and high contrast, of which the equivalent circle diameter was 0.6 $\mu$m or less and in which the position for introducing dislocation lines was controlled. However, it was proved in the foregoing embodiments that process stability and forced developability were not sufficient when coated in a multiplayer structure.

Specifically, in the field of color reversal photographic materials, an adjustment of sensitivity by processing, so-called forced development (or extended development) is employed to compensate underexposure, in which development of a silver halide grain emulsion exhibiting superior tone stability and tone balance for developing time, enhanced sensitivity and high contrast has been desired. Further, enhancement of color reproduction in relatively dark image portions (i.e., areas having lower lightness) is desired in the market. For example, JP-A 7-209785 disclosed a technique, in which a layer containing colloidal silver and a DIR coupler was provided between respective light-sensitive layers to control developability, thereby leading to enhanced suitability for forced development. In reversal photographic materials directly forming images through reversal development, however, such a DIR coupler formed a dye in images, making it difficult to use the coupler.

As described above, in silver halide emulsions and silver halide color photographic materials known in the art, enhancements in sensitivity, contrast, process stability and forced developability were not be achieved along with improved color reproduction.

SUMMARY OF THE INVENTION

Accordingly, it is an object of the present invention to provide a silver halide emulsion exhibiting a relatively high contrast, improved process stability and forced developability, even when coated in a multiplayer and a silver halide photographic material and a silver halide color photographic material by the use thereof.

The above object of the invention can be accomplished by the following constitution:

1. A silver halide emulsion comprising silver halide grains wherein the silver halide grains meet the following requirement:
   (a) at least 50% of total grain projected area is accounted for by tabular grains having an aspect ratio of not less than 5;
   (b) a coefficient of variation of total grain size distribution is not more than 25%;
   (c) an average iodide content of total grains is not more than 4 mol; and
   (d) the tabular grains each have major faces and contain dislocation lines in the peripheral region of the major face, and the tabular grains comprising a high iodide which is internal to and along the dislocation lines and an internal region surrounded by the high iodide phase, the internal region being comprised of substantially homogeneous silver halide phase and having an average iodide content of not more than 1 mol %;
2. A silver halide emulsion comprising silver halide grains wherein the silver halide grains meet the following requirement:
   (a) at least 50% of total grain projected area is accounted for by tabular grains satisfying the following equation:

$$A \geqq 4 \times \sqrt{\sqrt{x}}$$

wherein "A" represents an aspect ratio and "x" represents an average equivalent cube edge length, expressed in $\mu$m;

(b) a coefficient of variation of total grain size distribution is not more than 25%;
   (c) an average iodide content of total grains is not more than 4 mol; and
   (d) the tabular grains each have major faces and contain dislocation lines in the peripheral region of the major face, and the tabular grains comprising a high iodide which is internal to and along the dislocation lines and an internal region surrounded by the high iodide phase, the internal region being comprised of substantially homogeneous silver halide phase and having an average iodide content of not more than 1 mol %;
3. A silver halide photographic material comprising a support having thereon a light sensitive layer containing a silver halide emulsion as described in 1 or 2 above; and 4. A silver halide color reversal photographic material comprising a support having thereon a light sensitive layer containing a silver halide emulsion as described in 1 or 2 above.

As a result of extensive study to analyze factors with respect to the above-described items which were proved to be insufficient in the prior art, it was proved that the position to provide the high iodide phase along with introduction of dislocation lines was an important factor and the internal region having a low iodide content and a homogeneous composition promoted solution physical development. It was discovered that it was significant to enhance development activity of the side-face of the tabular grain, in which development was assumed to be initiated, and it was a point of grain design to control the iodide content of from the side-face to the high iodide phase, that is, to allow iodide to be localized in the iodide phase at a relatively high concentration, reducing the iodide content of the side-face portion.

In addition thereto, it was further discovered in tabular silver halide grains having a relatively high aspect ratio that it is important to control the position of the high iodide phase, formed along with the introduction of dislocation lines. Thus, when the high iodide phase is too external (i.e., when the dislocation lines are too short), iodide contents of the side-face and the shell increase, lowering development activity and resulting in low contrast, specifically when coated in a multiplayer structure. To the contrary, the high iodide phase is too internal (i.e., when the dislocation lines are to long), low contrast results. Accordingly, an appropriate design of the position of the high iodide phase (i.e., lengths of the dislocation lines) is important. However, sufficient effects were not achieved only by such a technique; specifically, contrast, process stability and suitability for extended development used in color reversal photographic materials were not attained to sufficient levels. It was further discovered that an internal region, surrounded by the high iodide phase, being substantially homogeneous and having a relatively low iodide content and the average overall iodide content of total grains being not high were necessary for tabular high aspect ratio grains containing a high iodide localization phase and exhibiting higher contrast and superior forced developability, thereby leading to the present invention. Furthermore, homogeneity of grains is significant to enhance effects of the invention. Thus, enhanced homogeneity of not only grain size but also grain thickness or dislocation line length (i.e., the distance the high iodide phase and the side-face) leads to a marked increase of the effects.

DESIGNATION OF NUMERALS

Figure 1A:
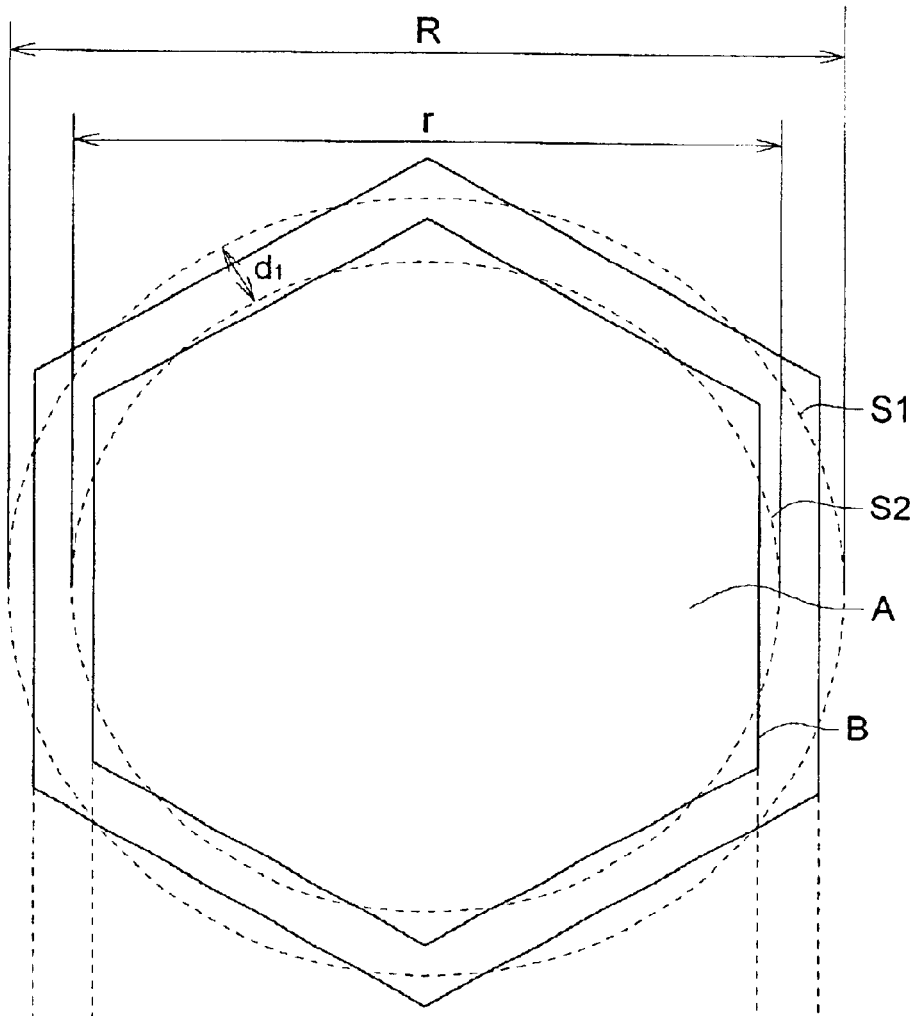
FIGS. 1A and 1B illustrate a silver halide grain of the invention, viewed from the direction vertical to the major face and from the direction vertical to the side face, respectively.
Figure 1B:
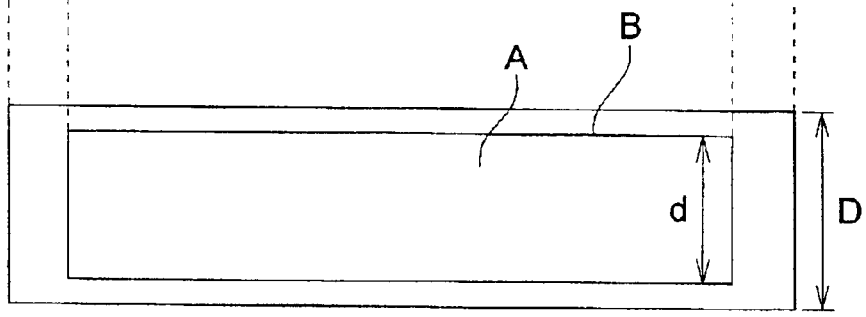

S1: Major face projected area (Equivalent circle area)

S2: Internal region projected area (Equivalent circle area)

R: Major face diameter r: Internal region diameter

D: Grain thickness d: Internal region thickness $d_1$: Distance of from a high iodide phase to a side face, which is equivalent to dislocation line length.

DETAILED DESCRIPTION OF THE INVENTION

Tabular silver halide grains relating to the invention (hereinafter, also denoted simply as tabular grains) refer to those which have two parallel major faces and at least 2 of an aspect ratio, that is, a ratio of equivalent circle diameter (i.e., diameter of a circle having the same area as that of the major face) to the distance between the major faces (i.e., grain thickness). In the invention, the grain diameter and grain thickness can be determined according to the method described in U.S. Pat. No. 4,434,226.

One aspect of the invention is that at least 50% of the total grain projected area is accounted for by tabular grains having an aspect ratio of at least 5, and preferably at least 7.

In the invention, it is preferred to cause the aspect ratio of the tabular grains to vary in accordance with the grain size. In this case, the grain size is represented in terms of an equivalent cube edge length, i.e., the edge length of a cube having the same volume as the grain. For example, tabular grains having an equivalent cube edge length of not less than 0.6 μm preferably have an aspect ratio of not less than 8; tabular grains having an equivalent cube edge length of not less than 0.4 μm and less than 0.6 μm preferably have an aspect ratio of not less than 5; tabular grains having an equivalent cube edge length of less than 0.4 μm preferably have an aspect ratio of not less than 3. Furthermore, the average equivalent cube edge length of the tabular grains relating to the invention is preferably not more than 0.6 μm, more preferably not more than 0.45 μm, and still more preferably 0.22 μm to 0.40 μm.

The tabular grains according to the invention each have a thickness (also denoted as "D") of not more than 0.20 μm, preferably 0.01 to 0.15 μm, and more preferably 0.02 to 0.07 μm. The internal low iodide region becoming thinner results in enhanced solubility at the time of development, leading to higher contrast and enhanced process stability and superior forced developability, following the same reasoning as for increasing the aspect ratio, as described above.

In the grain size distribution of the tabular grains relating to the invention, a coefficient of variation (hereinafter, also denoted as a variation coefficient) of an equivalent circle diameter of the major face is preferably not more than 25%, more preferably not more than 20%, and still more preferably not more than 10%. The variation coefficient of grain thickness is preferably not more than 40%, more preferably 30% and still more preferably not more than 20%.

Halide composition of the tabular grains relating to the invention is not specifically limited, but silver iodobromide or silver iodochlolobromide is preferred. In the invention, the average overall iodide content of total grains is not more than 4 mol %. In one preferred embodiment of the invention, the silver halide grains satisfy the following equation:

$$I_t \leq 1.8/x$$

where $I_t$ represents the average iodide content of the grains and x represents an average equivalent cube edge length (μm). For example, grains having an average equivalent cube edge length of more than 0.5 μm preferably have an average overall iodide content of not more than 2.5 mol %, and grains having an average equivalent cube edge length of 0.4 μm to 0.4 μm preferably have an average overall iodide content of not more than 3.5 mol %.

In the iodide content distribution among tabular grains, the coefficient of variation of iodide content (which is represented by a standard deviation of iodide contents of the grains, divided by an average iodide content) is preferably not more than 20%, and more preferably 10%. The tabular grains relating to the invention may be comprised of plural phases differing in halide composition. The structure concerning halide composition within the grain can be determined by commonly known methods, e.g., composition analysis such as X-ray diffractometry and EPMA.

The average surface iodide content of the tabular grains relating to the invention is preferably 0 to 15 mol %, and more preferably 0.1 to 10 mol %. In the invention, the surface iodide content is referred to as the iodide content on the overall surface of the grain. The average surface iodide content is preferably based on the overall iodide content. Thus, the average surface iodide content is preferably not less than 3 times the average overall iodide content. In the invention, the surface iodide content is a value which is determined by the XPS method described in JP-A 8-171157. Further, the surface iodide content of the side-face of tabular grains is needed to be low to enhance developability, which is determined by the XPS method. The average surface iodide content of the side-face is preferably not more than 3 mol %, more preferably not more than 2 mol %, and still more preferably not more than 1 mol %. Such an iodide content can be achieved, for example, by enhancing localization of the high iodide phase by the condensation method described later or by shelling grown-up grains by the use of fine silver halide grains of 0.1 μm or less and containing 4 mol % or less iodide.

The tabular grains relating to the invention each have two twin planes parallel to the major faces. The twin planes can be observed with a transmission electron microscope, concretely, according to the following manner. A coated sample is prepared by coating a silver halide emulsion on a support so that the major faces of tabular grains are arranged parallel to the support. The thus prepared sample is sliced, using a diamond cutter, to obtain a thin slice of approximately 0.1 μm thickness. The presence of the twin planes can be confirmed by observing the thus obtained slice with the transmission electron microscope.

The spacing between at least two twin planes of the tabular grains can be determined in a manner that in the foregoing electron microscopic observation of the slice, 1,000 tabular grains showing a section approximately vertical to the major faces of the grain are selected at random, the shortest spacing between twin planes among even number of twin planes is determined for each grain and the obtained shortest spacing between at least two twin planes are averaged for all the grains. The average spacing between two twin planes is preferably 0.01 to 0.05 μm, and more preferably 0.013 to 0.025 μm. A variation coefficient of the spacing between twin planes is preferably not more than 30% and more preferably not more than 20%. The spacing between at least two twin planes can be controlled by optimally selecting the combination of factors affecting the super-saturated state at nucleation, such as gelatin concentration, the kind of gelatin, temperature, iodide ion concentration, bromide ion concentration, hydrogen ion concentration, ion-supplying rate, and stirring rate (in rotation number). In general, nucleation at a higher super-saturation narrows the spacing between at least two twin planes. Super-saturation factors are referred to JP-A Nos. 63-92924 and 1-213637.

Tabular grains can be prepared by optimally combining methods known in the art, as described in JP-A Nos. 61-6643, 61-146305, 62-157024, 62-18556, 63-92942, 63-151618, 63-163451, 63-220238, and 63-311244. There can be employed a double-jet method, a controlled double-jet method, in which the liquid phase forming silver halide is maintained at a given pAg value (logarithmic reciprocal of a silver ion concentration) and a triple-jet method, in which soluble silver halides differing in halide compositions are independently added. There are also employed normal precipitation and reverse precipitation, in which silver halide grains are formed in excess of silver ions. To obtain highly monodispersed grains, it is preferable to control the pAg of the liquid phase forming silver halide grains so as to meet the grain growth rate. The pAg is preferably 7.5 to 11.0, and more preferably 8.0 to 10.5. The addition rate can be determined with reference to techniques described in JP-A Nos. 54-48521 and 58-49938.

Silver halide solvents may be optionally used. Silver halide solvents usable in the invention include, for example, ammonia and thioethers. The thioethers are referred to U.S. Pat. Nos. 3,271,157, 3,790,387 and 3,574,628, in which the precipitation process is not specifically limited, and a neutral process, ammoniacal process and acidic process are employed. To lower a, fogging level of silver halide grains, the pH (logarithmic reciprocal of hydrogen ion concentration) is preferably not more than 6.5, and more preferably not more than 5.5. Furthermore, to prevent agglomeration of grains and enhance suitability for the manufacturing process (e.g., coatability), the pH is preferably by at least 0.2 apart from the isoelectric point of a dispersing medium, such as gelatin.

The tabular grains relating to the invention contain an iodide. A method of adding iodide ions in the grain preparation is not specifically limited, for example, an ionic solution, such as potassium iodide solution may be added or fine silver iodide grains may be added. In the preparation of silver halide emulsions relating to the invention, it is preferred to carry out grain growth using fine silver halide grains, as described in JP-A Nos. 1-183417, 1-183644 and 1-183645. Specifically, the grain growth method described in JP-A No. 5-5966 can be employed, in which two kinds of fine silver halide grains are used and one of them is preferably silver halide having a single halide composition. Similarly to the method described in JP-A 2-167537 is preferred an emulsion comprised of silver halide grains which are grown in the presence of silver halide grains having solubility lower than growing grains. In such as case, silver iodide is preferably used as silver halide grains having lower solubility.

One aspect of the invention is that the tabular grains each have major faces and contain dislocation lines in the peripheral region (also denoted as fringe portion) of the major face and a high iodide phase is localized within the grain, along with introduction of dislocation lines.

The dislocation lines and high iodide-localized phase in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while ensuring not to exert any pressure that causes dislocation in the grains, and are then placed on a mesh for electron microscopy. The sample is observed by transmission electron microscopy, while being cooled to prevent the grains from being damaged (e.g., printing-out) by the electron beam. Since electron beam penetration is hampered as the grain thickness increases, sharper observations are obtained when using an electron microscope of a high voltage type. From the thus obtained electron micrograph, the position and form of the high iodide phase and the number of dislocation lines can be determined with respect to grains viewed from the direction vertical to the major faces. Further, with respect to grains viewed from the direction vertical to the side face, the position and form of the high iodide phase can also be determined by transmission electron microscopic observation of thin slices, which are prepared similarly to twin plane observation.

As a result of extensive study, it was proved that allowing dislocation lines to be closely present in the fringe portion of the tabular grain resulted in enhanced developability as well as enhanced sensitivity, leading to improvements in contrast, process stability and forced developability, as intended in the invention. The tabular grains relating to the invention preferably contain at least 10, and more preferably at least 30 dislocation lines per grain. Developability of silver halide grains is variable relating to grain size and an average iodide content. The larger grain size or the higher iodide content lowers solubility of the grains, resulting in lowered developability and often resulting in lowered contrast. It is preferred to adjust the proportion by number of tabular grains having at least 30 dislocation lines in accordance with the grain size and average iodide content.

In the tabular grains relating to the invention, the high iodide phase is localized preferably external to 65% of the grain volume, and more preferably internal to 90% of the grain volume, in the direction of the diameter of the major face or thickness.

In one embodiment of the invention, the average length of the dislocation lines, i.e., the distance of the location having a maximum iodide content in high iodide phase from a side-face of the tabular grain ($d_1$) is preferably not more than a prescribed value, more preferably not more than 65 nm, and still more preferably 25 to 65 nm. When the high iodide phase is internally localized, unintended contrast reduction occurs easily.

Similarly to the foregoing, the high iodide phase of the tabular grains relating to the invention can be observed as a contour pattern, using a transmission electron microscope. Usually, the color density of the contour represents an iodide content, the highest density portion indicating the maximum iodide containing portion. When viewed from the direction vertical to the major faces, the tabular grains relating to the invention are usually observed as a hexagonal or circular contour; when viewed from the direction vertical the side-face, the grains are usually observed as a rectangular or ellipsoidal contour; but the contour is not limited to these shapes.

The position of the high iodide phase of the tabular grains can be confirmed by observing the section of a slice of the grain with a transmission electron microscope, i.e., by measuring the position of the contour when viewed from direction vertical to the side-face.

The distance ($d_1$) of from the side-face to the position having the maximum iodide content in the high iodide phase can be determined according to the following equation:

$$d_1=(R-r)/2$$

where "r" represents an equivalent circle diameter of the contour when viewed from the direction vertical to the major faces under a transmission electron microscope and "R" represents an equivalent circle diameter of the major face.

In cases where the major faces of the tabular grains is hexagonal, the dislocation lines in the peripheral region is preferably concentrated into edge portions of the hexagonal major face. From the view point of uniformity in developability, effects equivalent to the case of the dislocation lines being homogeneous in length. The dislocation lines may be concentrated any edge and is preferably concentrated to six corners. In this case, the dislocation lines may exist in edge portions of the peripheral region and preferably only in the corners.

In the invention, the internal region surrounded by the high iodide phase refers to a portion internal to the foregoing contour when viewed from the direction vertical the major face and also refers to a portion internal to the contour when viewed from the direction vertical to the side-face. The iodide content of the internal region can be determined by the EPMA method, in which the measurement beam diameter is reduced, for example, in accordance with the following manner. Thus, when a slice of the tabular grain, which is prepared in a manner similar to the foregoing determination of the spacing between twin planes is viewed from the direction vertical to the section, a line, which passes through the center of the major faces opposite to each other, is drawn inside the contour described above and iodide contents are measured at intervals of not more than 10% of the line length, in which the measurement spot is made to be not less than 40 nm. Herein, the center of the major face corresponds to the center of gravity of the major face. In cases when an iodide slope of the vicinity of the high iodide phase to the maximum iodide point is measured, this iodide slope portion is included in the high iodide phase, not in the internal region. Taking damage of a sample into account, it is necessary to cool the measuring temperature to −100° C. or lower. The total time at each of the measurement points is to be not less than 30 sec. The thus measured iodide contents at respective points are averaged to determine the average iodide content of the internal region.

The internal region surrounded by the high iodide phase of the tabular grain relating to the invention is preferably a substantially homogeneous phase, having an average iodide content of not more than 1 mol %. The substantially homogeneous phase means that the difference between maximum and minimum iodide contents, except for the iodide content of the central seed grain portion is less than 2.0 mol %, and the difference from the iodide content of the central seed grain portion is less than 5.0 mol %. The internal region preferably contains substantially no iodide. The less iodide content is the more soluble and activates dissolution at the time of development, enhancing the rate of supplying silver ions to the development-initiating point thereby increasing development activity, leading to preferable results with respect to higher contrast and suitability for development and sensitization. The expression, substantially no iodide means the maximum value of the foregoing measurement points being less than 2.0 mol %.

The method for introducing the dislocation lines is not specifically limited, however, a method of introducing the dislocation by employing a steep gap of the silver halide lattice constant due to a steep difference in halide composition is preferred, in which a high iodide layer is formed at the time of starting the introduction of the dislocation lines and then a lower iodide layer is formed outside the high iodide layer. Examples of the method for forming the high iodide include addition of an aqueous iodide (e.g., potassium iodide) solution, along with an aqueous silver salt (e.g., silver nitrate) solution by a double jet technique; addition of silver iodide fine grains; addition of an iodide solution alone and addition of a compound capable of releasing an iodide ion as described in JP-A Nos. 6-11781 and 8-62754. Of these, the addition of an aqueous iodide solution, along with an aqueous silver salt solution by a double jet technique, the addition of fine silver iodide grains and of these, the addition of an iodide solution alone and addition of a compound capable of releasing an iodide ion are preferred, and the addition of fine silver iodide grains is more preferred.

Preferred as a technique for controlling the dislocation lines without varying the iodide composition within the grain is concentration of the reaction solution volume within a reaction vessel immediately before initiating the introduction of dislocation lines, i.e., immediately before forming the high iodide phase. In one preferred embodiment of the invention, the reaction solution volume within the reaction vessel is concentrated to not more than 2.5 lit., and more preferably to 0.5 to 2.0 lit. per mol of silver halide contained in the reaction solution, immediately before forming the high iodide phase. As concentration techniques applicable to the invention, for example, it is preferred to remove only water or a soluble compound containing solution from the reaction solution during grain formation, using an apparatus having a concentration mechanism such as an ultrafiltration apparatus, connected to the reaction vessel. The timing of concentration is not specifically limited, and the concentration may be carried out along with grain growth, alternatively, the grain growth is temporarily stopped, followed by concentration, but a combination thereof is preferred.

Figure 2:
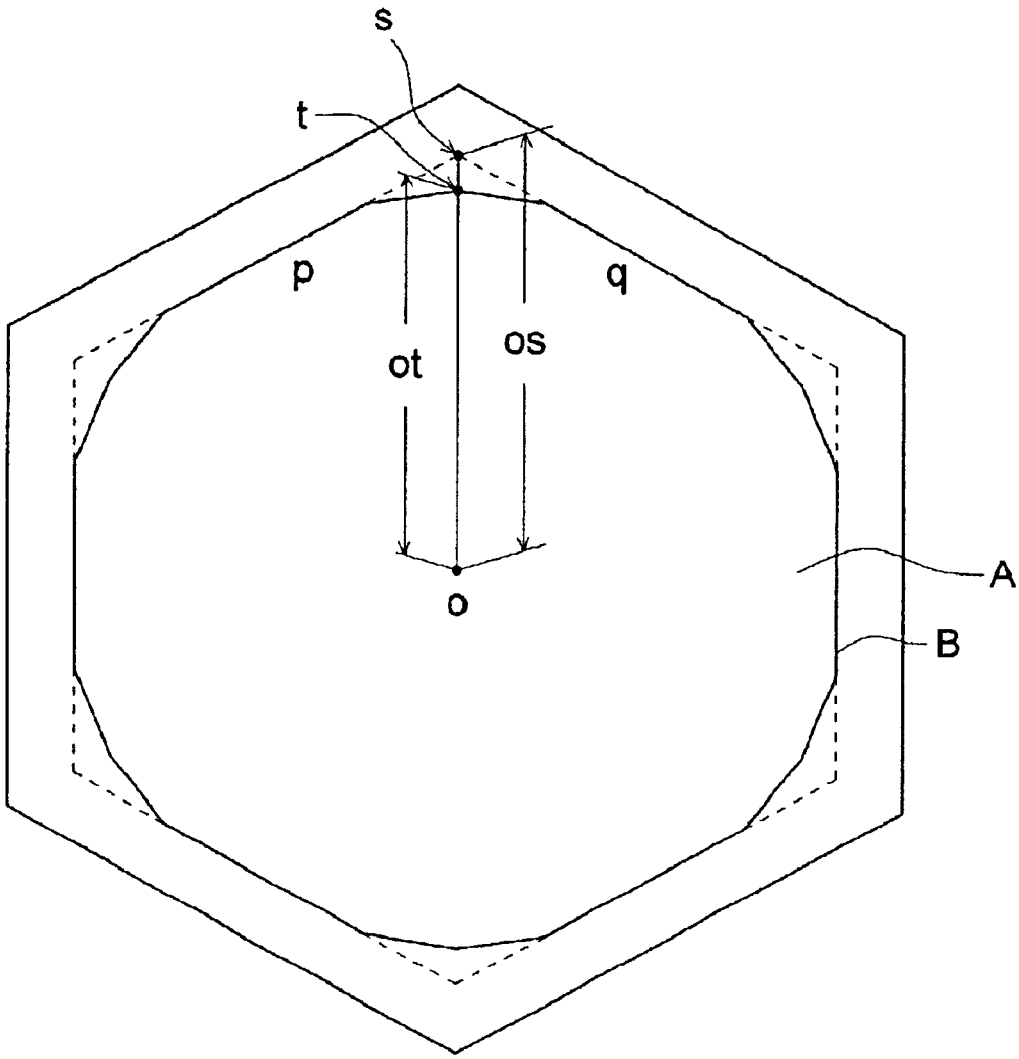
FIG. 2 is an illustration of an internal region surrounded by a high iodide phase.

In the invention, the form of the portion surrounded by the high iodide phase preferably is substantially hexagonal when viewed from the direction vertical to the major faces. In the view from the direction vertical to the major face, as shown in FIG. 2, when a line connecting intersection (s) of adjacent edges (p and q) and the center of the grain projected area intersects the high iodide phase contour at point (t), the substantially hexagonal form means a form having a ratio of the length of line "ot" to line "os" of 0.90 or more, and preferably 0.95 or more.

In the tabular grains relating to the invention, the internal region surrounded by the high iodide phase, that is, a host grain immediately before the formation of the high iodide phase has a relatively low iodide content, exhibiting relatively high solubility. Accordingly, in tabular grains comprised of a high iodide phase and an internal region containing relatively low iodide, it is preferable to render the reaction system to be supersaturated to prevent elution of silver ions from the corners at the time of forming the high iodide phase. To achieve this, concentration of a reaction solution within a reaction vessel is effective and lowering the temperature of the reaction system is also preferred. The temperature at the time of forming the high iodide phase is preferably not more than 75° C., more preferably not more than 65° C., and still more preferably not more than 45° C. Furthermore, to prevent elution of silver ions from the corners, it is preferred to increase the silver ion concentration at the start of forming the high iodide phase to restrain the supply of silver ions from the internal region inside the high iodide phase (host grain). The pAg of the reaction system at the start of forming the high iodide phase is preferably not more than 9.9, more preferably not more than 9.7, and still more preferably not more than 9.5.

It was further revealed in the tabular grains relating to the invention that making the ratio of an aspect ratio of the internal region inside the high iodide phase to that of the grownup grain to be not more than a given value, or making the ratio of a thickness of the internal region inside the high iodide phase to that of the grown-up grain to be not more than a given value resulted in enhanced contrast and improvement in development suitability and forced developability. In one preferred embodiment of the invention, the aspect ratio of the internal region inside the high iodide phase to that of the grown-up grain is not more than 1.10, preferably 0.8 to 1.0, and more preferably 0.9 to 1.0. In another preferred embodiment of the invention, the ratio of thickness (d) of the internal region inside the high iodide phase to thickness (D) of the grown-up grain is not less than 0.90. The thickness of the internal region of the tabular grain refers to length of the minor axis of the high iodide phase contour obtained when the foregoing slice is viewed from the direction vertical to the side-face, with a transmission electron microscope. The aspect ratio of the internal region is represented by the value of diameter (r) of a circle having the same area as a portion surrounded by the high iodide phase contour obtained when viewed from the direction vertical to the major face with a transmission electron microscope, divided by the thickness (d) described above.

In the invention, the surface iodide content of the side-face of tabular grains is preferably lower in terms of developability. The high iodide phase of the tabular grains is localized preferably at the side face side rather than the major face side. Decreasing the iodide content at the major face side activates dissolution of the internal region, enhancing high-contrast, development suitability and forced developability, as intended in the invention. Thus, the average iodide content of the side-face side ($I_d$) and the average iodide content of the major face side ($I_r$) meet the following requirement:

$$I_d > I_r.$$

The $I_d$ is determined in such a manner that the slice of a grain described above is observed from the direction vertical to the section, i.e., from the direction vertical to the side-face and both sides' minor axes of the high iodide contour vertical to two major faces opposite to each other are measured by the narrowed beam EPMA method, in which the measurement beam diameter is thinned, as described earlier. Iodide contents are measured at intervals of not more than 10% of the minor axis length and averaged for respective measured values. In this case, the measurement spot diameter is not more than 30 nm. Similarly to $I_d$, $I_r$ is also determined by the measurement of iodide contents of both major axes of the high iodide contour parallel to the two major faces.

The tabular grains relating to the invention preferably contain a hole-trap zone in at least a portion of the internal region surrounded by the high iodide phase. In the invention, the hole trap zone is referred to as a zone having the function of trapping a so-called hole, e.g., a hole paired with a photoelectron produced through photoexcitation. Sensitization effects due to the presence of a hole trap zone are described in JP-A No. 8-211524.

There are various methods for providing such a hole trap zone and in the invention, it is preferred to provide it by reduction sensitization. The position to provide the hole trap zone is within the internal region surrounded by the high iodide phase, preferably internal to 70% of the grain volume, and more preferably internal to 50% of the grain volume. A part or all of such an internal side may be a hole rap zone. Adding a reducing agent to a silver halide emulsion or a solution to be used for grain growth can carry out the foregoing reduction sensitization. Alternatively, ripening or grain growth is carried out under the condition that a silver halide emulsion or a solution to be used for grain growth is maintained at a pAg of 7 or less, or at a a pH of 7 or more. Further, combinations of these methods may also be conducted. Furthermore, reduction sensitization may be conducted before or after the chemical sensitization process described in JP-A Nos. 7-219093 and 7-225438. The reduction sensitization may be conducted in the presence of an oxidizing agent, and preferably, a compound represented by formulas (1) to (3) described below. Preferred reducing agents include thiourea dioxide, ascorbic acid and its derivatives and stannous salts. Examples of other reducing agents include borane compounds, hydrazine derivatives, formamidine sulfinic acid, silane compounds, amines and polyamines, and sulfites. The reducing agent is added preferably in an amount of $10^{-8}$ to $10^{-2}$ mol per mol of silver halide.

To ripen at low pAg, a silver salt may be added and aqueous soluble silver salts are preferably employed, such as silver nitrate. The pAg during ripening is not more than 7, preferably not more than 6, and more preferably between 1 and 3 (in which pAg=−log [$Ag^+$]). To ripen at high pH, an alkaline compound may be added to a silver halide emulsion or a reaction mixture solution for grain growth. Examples of the alkaline compound include sodium hydroxide, potassium hydroxide, sodium carbonate, potassium carbonate and ammonia. In the case when adding ammoniacal silver nitrate to form silver halide, alkaline compounds other than ammonia are preferably employed.

The silver salt or alkaline compound may be added instantaneously or in a given time, and at a constant flow rate or a variable flow rate. The addition may be dividedly made. Prior to the addition of aqueous soluble silver salt and/or halide, the silver salt or alkaline compound may be allowed to be present in a reaction vessel. Further, the silver salt or alkaline compound may be incorporated to an aqueous silver salt solution and added together with the aqueous soluble silver salt. Furthermore, the silver salt or alkaline compound mat be added separately from the aqueous soluble silver salt or halide.

An oxidizing agent may be added to the silver halide emulsion during the formation thereof. The oxidizing agent is a compound capable of acting on metallic silver to convert to a silver ion. The silver ion may be formed in the form of a scarcely water-soluble silver salt, such as silver halide, silver sulfide or silver selenide, or in the form of an aqueous soluble silver salt, such as silver nitrate. The oxidizing agent may be inorganic compound or an organic compound. Examples of inorganic oxidizing agents include ozone, hydrogen peroxide and its adduct (e.g., $NaBO_2.H_2O_2.3H_2O$, $2Na_2CO_3.3H_2O_2$, $Na_4P_2O_7.2H_2O_2$, $2Na_2SO_4.H_2O_2.H_2O$), peroxy-acid salt (e.g., $K_2S_2O_8$, $K_2C_2O_6$, $K_4P_2O_8$), peroxy-complex compound {$K_2[Ti(O_2)OOCCOO].3H_2O$, $4K_2SO_4$ $Ti(O_2)OH.SO_4.2H_2O$, $Na_3[VO(O_2)(OOCCOO)_2.6H_2O]$}, oxygen acid such as permaganates (e.g., $KMnO_4$), chromates e.g., $K_2Cr_2O_7$), halogen elements such as iodine or bromine, perhalogenates (e.g., potassium periodate), high valent metal salts (e.g., potassium ferricyanate) and thiosulfonates. Examples of organic oxidizing agents include quinines such as p-quinone, organic peroxides such as peracetic acid and perbenzoic acid, and active halogen-releasing compounds (e.g., N-bromsuccimide, chloramines T, chloramine B). Of these oxidizing agents, ozone, hydrogen peroxide and its adduct, halogen elements, thiosulfonate, and quinines are preferred. Specifically, thiosulfonic acid compounds represented by the following formulas (1) to (3) are preferred, and the compound represented by formula (1) is more preferred:

$$R^1—SO_2S—M \quad (1)$$

$$R^1—SO_2S—R^2 \quad (2)$$

$$R^1SO_2S—L_nSSO_2—R^3 \quad (3)$$

where $R^1$, $R^2$ and $R^3$, which may be the same or different, represent an aliphatic group, aromatic group or a heterocyclic group; M is a cation, L id a bivalent linkage group; and n is 0 or 1. The oxidizing agent is incorporated preferably in an amount of $10^{-7}$ to $10^{-1}$ mole, more preferably $10^{-6}$ to $10^{-2}$ mole, and still more preferably $10^{-5}$ to $10^{-3}$ mole per mole of silver. The oxidizing agent may be added during grain formation, or before or during forming structure having different halide compositions. The oxidizing agent can be incorporated according to the conventional manner. For examples, an aqueous soluble compound may be incorporated in the form of an aqueous solution; an aqueous insoluble or sparingly soluble compound may be incorporated through solution in an appropriate organic solvent (e.g., alcohols, glycols, ketones, esters and amides).

Gelatin used as a protective colloid include an alkali processed gelatin and acid processed gelatin. Preparation of gelatin is detailed in A. Veis, The Macromolecular Chemistry of Gelatin, published Academic press, 1964. Examples of hydrophilic colloidal materials other than gelatin include gelatin derivatives, a graft polymer of gelatin and other polymer, proteins such as albumin and casein, cellulose derivatives such as hydroxyethyl cellulose, cabboxymethyl cellulose and cellulose sulfuric acid esters, saccharide derivatives such as sodium alginate and starch derivatives and synthetic polymeric materials, such as polyvinyl alcohol, polyvinyl alcohol partial acetal, poly-N-vinyl pyrrolidone, poyacrylic acid, polymethacrylic acid, polyacrylamide, polyvinyl imidazole and polyvinyl pyrazole, including their copolymers. Gelatin is preferably one which exhibits not less tan 200 g of a jerry strength, defined in the PAGI method.

It is preferred to allow salts of metal ion salts to be concurrently present at the stage of forming, desalting, chemical ripening or before coating the tabular grains relating to the invention. Such metals include, for example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. Specifically, it is preferred to occlude Ir in the grain for the purpose of improving intensity reciprocity failure. The metal ion of less than $1\times10^{-5}$ mol per mol of silver exhibits a marked effect on high intensity reciprocity failure and the content of not less than $1\times10^{-5}$ mol per mol of silver markedly contributes to improvement of low intensity reciprocity failure. Incorporation of Fe or Ru in the tabular grains results in a preferable sensitization effect. Including any metal ion of Ir, Fe and Ru into the tabular grains results in effects characteristic to respective ions. The metal is incorporated in the form of an ammonium, acetate, nitrate, sulfate, phosphate, hydroxide, or a metal complex salt such as six-coordinated complex and four-coordinated complex. Exemplary examples thereof include $Pb(NO_3)_2$, $K_2Fe(CN)_6$, $K_3RhCl_6$ and $K_4Ru(CN)_6$. A chalcogen compound may be added during the preparation of emulsions, as described in U.S. Pat. No. 3,772,031. Chalcogen compounds described in U.S. Pat. No. 3,772,031 may be incorporated during the emulsion making.

The silver halide grain emulsions may be subjected to desalting to remove soluble salts. Desalting can be applied at any time during the growth of silver halide grains, as described in JP-A No. 60-138538. Desalting can be carried out according to the methods described in Research Disclosure Vol. 176, item 17643, section II at page 23. Exemplarily, a noodle washing method in which gelatin is gelled, and a coagulation process employing an inorganic salts, anionic surfactants (e.g., polystyrene sulfonic acid) or a gelatin derivative (e.g., acylated gelatin, carbamoyl gelatin) are used. Alternatively, ultrafiltration can also be applied, as described in JP-A No. 8-228468.

Silver halide grains used in the invention may be subjected to chemical sensitization. Chalcogen sensitization with a compound containing a chalcogen such as sulfur, selenium or tellurium, or noble metal sensitization with a compound of a noble metal such as gold are performed singly or in combination.

Tabular silver halide grain emulsions relating to the invention are preferably subjected to selenium sensitization. Preferred selenium sensitizers are described in JP-A 9-265145. The amount of a selenium compound to be added, depending on the kind of the compound, the kind of a silver halide emulsion and chemical ripening conditions, is preferably $10^{-8}$ to $10^{-3}$ moles, and more preferably $5\times10^{-8}$ to $10^{-4}$ mole per mol of silver. The selenium compound may be added through solution in water or an organic solvent such as methanol, ethanol or ethyl acetate. It may be added in the form of a mixture with an aqueous gelatin solution. Further, it may be added in the form of a emulsified dispersion of an organic solvent-soluble polymer, as described in JP-A 4-140739. The pAg at the time of selenium sensitization is preferably 6.0 to 10.0, and more preferably 6.5 to 9.5. The pH is preferably 4.0 to 9.0, and more preferably 4.0 to 6.5; and the temperature is preferably 40 to 90° c. and more preferably 45 to 85° C. The selenium sensitization may be performed in combination with sulfur sensitization, gold sensitization, or both of them.

There can be employed sulfur sensitizers described in U.S. Pat. Nos. 1,574,944, 2,410,689, 2,278,947, 2,728,668, 3,501,313, and 3,656,955; West German Patent (OLS) 1,422,869; JP-A 55-45016, 56-24937, and 5-165135. Preferred exemplary examples thereof include thiourea derivatives such as 1,3-diphenyl thiourea, triethylthiourea and 1-ethyl-3(2-thiazolyl)thiourea; rhodanine derivatives; dithiacarbamates, polysulfide organic compounds; and sulfur single substance. The amount of the sulfur sensitizer to be added, depending on the kind of the compound, the kind of a silver halide emulsion and chemical ripening conditions, is preferably $1\times10^{-9}$ to $10^{-4}$ moles, and more preferably $1\times10^{-8}$ to $1\times10^{-5}$ mole per mol of silver.

Examples of gold sensitizers include chloroauric acid, gold thiosulfate, gold thiocyanate, and gold complexes of thioureas, rhodanines and other compounds. The amount of a gold sensitizer to be added, depending on the kind of silver halide emulsion, the kind of a compound to be used and ripening conditions, is preferably $1\times10^{-9}$ to $1\times10^{-4}$ mol and more preferably $1\times10^{-8}$ to $1\times10^{-5}$ mol per mol of silver halide.

Further, chemical sensitizers to be used in combination include noble metal salts such as platinum, paradium and rhodium, as described in U.S. Pat. Nos. 2,448,060, 2,566,245 and 2,566,263. The chemical sensitization may be carried out in the presence of thiocyanates (e.g., ammonium thiocyanate, potassium thiocyanate) or tetra-substituted thioureas (e.g., tetramethylthiourea), which are a silver halide solvent.

The silver halide grains used in the invention may be a surface latent image type or internal latent image type, including internal latent image forming grains described in JP-A 9-222684.

In addition to the tabular silver halide grains described above, silver halide emulsions which are prepared referring to, for example, JP-A Nos. 61-6643, 61-14630, 61-112142, 62-157024, 62-18556, 63-9294263-151618, 63-163451, 63-220238, 63-311244; RD38957 Sect. I and III, and RD40145 Sect. XV, can be employed in silver halide photographic materials relating to the invention.

Silver halide emulsions used for constituting the silver halide photographic material relating to the invention preferably are spectrally sensitized. Additives used in the stage of spectral sensitization are described in RD38957 Sect. IV and V and RD40145 Sect. XV. Furthermore, commonly known photographic additives usable in the invention are also described in RD38957 Sect. II–X and RD40145 Sect. I–XIII.

There can be incorporated couplers into respective red-, green- and blue-sensitive silver halide emulsion layers. It is preferred that dyes formed of couplers contained in these layers, each exhibit an absorption maximum of at least 20 nm apart from the other. Cyan, magenta and yellow couplers are used as couplers. Combinations of a cyan coupler and red-sensitive layer emulsion layer, a magenta coupler and green-sensitive, and a yellow coupler and blue-sensitive layer are usually employed as a combination of a coupler and emulsion layer, but are not limited to these and other combinations are applicable.

DIR compounds are usable in the invention. Preferred DIR compounds usable in the invention include, for example, D-1 through D-34 described in JP-A No. 4-114153. Furthermore, examples of DIR compounds usable in the invention include those described in U.S. Pat. Nos. 4,234,678, 3,227,554, 3,647,291, 3,958,993, 4,419,886, and 3,933,500; JP-A Nos. 57-56837, 51-13239; U.S. Pat. Nos. 2,072,363 and 2,070,266; and RD40145 Sect. XIV.

Exemplary examples of couplers usable in the invention are described in RD40145 Sect. II. The additives used in the invention can be incorporated by the dispersing method described in RD40145.

There can be employed supports described in RD38957 Sect. XV. Photographic materials can be provided with an auxiliary layer such as a filter layer or interlayer, as described in RD30957 Sect. XI. The photographic materials may have various layer arrangements such as conventional layer order, reverse order and unit constitution, as described in RD30957 Sect. XI.

The present invention is applicable to various types of color photographic materials, including color negative films for general use or cine use, color reversal films for slide or television use, color paper, color positive films and color reversal paper. Specifically, application of the silver halide emulsions of the invention to color reversal silver halide photographic materials results in effects intended in the invention, such as high contrast, process stability and forced developability.

Silver halide photographic materials can be processed using commonly known developers described in, for example, T. H. James, The Theory of The Photographic Process, Forth Edition, page 291–334 and Journal of the American Chemical Society, vol. 73, page 3,100 (1951), in accordance with commonly known methods, as described in RD38957 Sect. XVII–XX and RD40145 Sect. XXIII.

The silver halide photographic material according to the invention may be provided with a magnetic recording layer for imputing information regarding photographic materials, such as the kind, manufacturing number, maker's name and the emulsion number; information regarding camera-photographing, such as the picture-taking date and time, aperture, exposing time, climate, picture-taking size, the kind of camera, and the use of an anamorphic lens; information necessary for printing, such as the print number, selection of filter, favorite of customers and trimming size; and information regarding customers.

The magnetic recording layer is provided on the side opposite to photographic component layers. A sublayer, an antistatic layer (conductive layer), a magnetic recording layer and a lubricating layer are preferably provided on the support in this order. As fine magnetic powder are employed metal magnetic powder, iron oxide magnetic powder, Co-doped iron oxide magnetic powder, chromium dioxide magnetic powder and barium ferrite magnetic powder. The magnetic powder can be manufactured according to the known manner.

The optical density of the magnetic recording layer is desirably as low as possible, in terms of influence on photographic images, and is preferably not more than 1.5, more preferably not more than 0.2, and still more preferably not more than 0.1.

The magnetic susceptibility of the magnetic recording layer is preferably not less than $3\times10^{-2}$ emu per $m^2$ of photographic material. The magnetic susceptibility of less than $3\times10^{-2}$ emu per $m^2$ often produces troubles in input and output of magnetic recording.

The thickness of the magnetic recording layer is preferably between 0.01 and 20 $\mu$m, more preferably 0.05 and 15 $\mu$m, and still more preferably 0.1 and 10 $\mu$m. As a binder of the magnetic recording layer are preferably employed vinyl type resin, urethane type resin and polyester type resin. It is also preferred to form a binder by coating an aqueous emulsion resin without the use of an organic solvent. The binder can be hardened by a hardener, thermal means or electron beam to adjust physical properties. Specifically, hardening with a poly-isocyanate type hardener is preferred. An abrasive can be contained in the magnetic recording layer for preventing clogging, and non-magnetic metal oxide particles, such as alumina fine particles are preferably employed.

Support of the photographic material include polyester films such as polyethylene terephthalate (PET) and polyethylene naphthalate (PEN), cellulose triacetate film, cellulose diacetate film, polycarbonate film, polystyrene film and polyolefin film. In particular, a high moisture containing polyester support is superior in recovery of roll-set curl after processing even when the support is thinned, as described in JP-A 1-244446, 1-291248, 1-298350, 2-89045, 2-93641, 2-181749, 2-214852, and 2-291135. In the invention, Pet and PEN are preferably employed as a support. The thickness thereof is preferably between 50 and 100 $\mu$m, and more preferably 60 to 90 $\mu$m.

The photographic material according to the invention preferably has a conductive layer containing a metal oxide particles, such as ZnO, $V_2O_5$, $TiO_2$, $SnO_2$, $Al_2O_3$, $In_2O_3$, $SiO_2$, MgO, BaO or $MoO_3$. The metal oxide particles containing a small amount of oxygen deficiency or a hetero atom forming a donor to the metal oxide, which is high conductive, preferably employed. Specifically, the latter, which does not provide fog to the silver halide emulsion, is preferred.

Binders used in the conductive layer or a sublayer are the same as those used in the magnetic recording layer.

As a lubricating layer provided on the magnetic recording layer is coated a higher fatty acid ester, a higher fatty acid amide, poly-organosiloxane, a liquid paraffin or a wax.

In cases where the photographic material according to the invention is employed as a roll-formed color photographic camera material, not only miniaturization of a camera or patrone is achieved, but saving of natural resource is also possible. Since storage space for a negative film is small, the width of the film is 20 to 35 mm, and preferably 20 to 30 mm. If the photographing picture area is within the range of 300 to 700 $mm^2$, preferably, 400 to 600 $mm^2$, small format becomes possible without deteriorating image quality of a final photographic print, leading to further miniaturization of cartridge and camera. The aspect ratio of a photographic image area is not limited and various types are employed, such as conventional 126 size of 1:1, a half-size of 1:1.4, 135 (standard) size of 1:1.5, hi-vision type of 1:1.8 and panorama type of 1:3.

When the photographic material according to the invention is used in a roll form, it is preferably contained in a cartridge. The most popular cartridge is a 135 format patrone. There are also employed cartridges proposed in Japanese Utility Model Application Opened to Public Inspection No. 58-67329 and 58-195236; JP-A 58-181035 and 58-182634; U.S. Pat. No. 4,221,479; JP-A 1-231045, 2-170156, 2-199451, 2-124564, 2-201441, 2-205843, 2-210346, 2-211443, 2-214853, 2-264248, 3-37645 and 3-37646; U.S. Pat. Nos. 4,846,418, 4,848,693 and 4,832,275. It is possible ally to "small-sized photographic roll film patrone and film camera" disclosed in JP-A 5-210201.

EXAMPLES

The present invention will be further described based on examples but embodiments of the invention are by no means limited to these.

Example 1

Preparation of Silver Halide Emulsion

Preparation of Emulsion Em 1-1

Nucleation Stage

Mother liquor (Gr-1), as shown below, within a reaction vessel was maintained at 30° C. with stirring at a rate of 400 rpm, using a mixing stirrer described JP-A No. 62-160128 and the pH was adjusted to 1.96 using 0.5 mol/l sulfuric acid solution. Thereafter, the following solutions (S-1) and (H-1) were added by double jet addition at a constant flow rate over a period of 1 min. to perform nucleation. In this addition, 3.52% of solution (S-1) and 9.91% of solution (H-1) were used.

| | |
|---|---|
| Gr-1 | |
| Alkali-processed inert gelatin | 28.43 g |
| Potassium bromide | 8.66 g |
| Distilled water to make | 11.4 lit. |
| S-1 | |
| Silver nitrate | 1800.0 g |
| Distilled water to make | 8.48 lit. |
| H-1 | |
| Potassium bromide | 447.7 g |
| Distilled water to make | 3.01 lit. |

Ripening Stage

After completion of the foregoing nucleation, the following solution (G-1) was added thereto and the temperature was raised to 60° C. in 30 min., while maintaining the silver halide emulsion within the reaction vessel at 0 mV of a silver potential, which was measured by a silver ion selection electrode and a saturated silver—silver chloride electrode as a reference electrode, using an aqueous 1.75 mol/l potassium bromide solution. Subsequently, an aqueous ammonia solution was added thereto and the pH was adjusted to 9.3 with a 1 mol/l potassium hydroxide solution and after being maintained for 7 min., the pH was adjusted to 5.5 using an aqueous acetic acid solution, while the silver potential was maintained at 0 mV using an aqueous 1.75 mol/l potassium bromide solution.

| G-1 | |
|---|---|
| Alkali-processed inert gelatin (mean molecular weight of ca. 100,000) | 122.1 g |
| 10 wt % Methanol solution of EO-1*[1] | 4.09 ml |
| Distilled water to make | 3.18 lit. |

*[1]EO-1: $HO(CH_2CH_2O)_m[CH(CH_3)CH_2O]_{19.8}(CH_2CH_2O)_nH$(m + n = 9.77)

Growth Stage of Internal Region

After completion of the foregoing ripening stage, subsequently, solution (S-1) described above and solution (H-2) were added by double jet addition at an accelerated flow rate (approximately 6 times from start to finish) over a period of 90 min., while the silver potential was maintained at +6 mV using an aqueous 1.75 mol/l potassium bromide solution. In this stage, 64.48% of the total amount of solution (S-1) was used, i.e., 68% of the total silver amount of final silver halide grains was consumed from start of the nucleation stage to finish of this stage.

| H-2 | |
|---|---|
| Alkali-processed inert gelatin (mean molecular weight of ca. 100,000) | 49.2 g |
| Potassium bromide | 806.5 g |
| Potassium iodide | 9.07 g |
| Water to make | 5.47 lit. |

Introduction of High Iodide Phase and Shell Growth

After completion of growth of the internal region, the temperature within the reaction vessel was lowered to 40° C. and reaction mixture was concentrated to 14.3 lit. using an ultrafiltration apparatus. Thereafter, solution (A-1) was added and solution (B-1) was subsequently added, then, the pH was adjusted to 9.3 with an aqueous 1 mol/l potassium hydroxide solution and ripening was conducted over period of 9 min. to release iodide ions. Thereafter, the pH was adjusted to 5.5 with an aqueous acetic acid solution and the silver potential was adjusted to −40 mV using an aqueous 1.75 mol/l potassium bromide solution, subsequently, remaining solutions (S-1) and (H-1) described above were added at an accelerated flow rate, while the reaction mixture was maintained at a constant volume until completion of the growth stage, using the ultrafiltration apparatus.

| A-1 | |
|---|---|
| Sodium p-iodoacetoamidobenzenesufonate | 96.2 g |
| $H_2O$ | 822.0 ml |
| B-1 | |
| Sodium sulfite | 33.4 g |
| $H_2O$ | 344.2 ml |

After completion of the foregoing grain growth, desalting was carried out in accordance with the method described in JP-A 5-72658, gelatin was added and dispersed, then, the pH and pAg were adjusted to 5.80 and 8.80, respectively, to obtain emulsion Em 1-1.

Preparation of Emulsion Em 1-2

Emulsion Em 1-2 was prepared similarly to emulsion Em 1-1, except that solution (H-2) was replaced by solution (H-3).

| H-3 | |
|---|---|
| Alkali-processed inert gelatin (mean molecular weight of ca. 100,000) | 49.2 g |
| Potassium bromide | 813.0 g |
| Water to make | 5.47 lit. |

Preparation of Emulsion Em 1-3

Emulsion Em 1-3 was prepared similarly to emulsion Em 1-2, except that solutions (Gr-1) and (G-1) were replaced by the following solutions (Gr-2) and (G-2), respectively; and solutions (S-1) and (H-1) were added for 1 min. in the nucleation stage.

| Gr-2 | |
|---|---|
| Alkali-processed inert gelatin | 40.62 g |
| Potassium bromide | 12.37 g |
| Distilled water to make | 16.3 lit. |
| G-2 | |
| Alkali-processed inert gelatin (mean molecular weight of ca. 100,000) | 174.5 g |
| 10 wt % Methanol solution of EO-1*[1] | 5.84 ml |
| Distilled water to make | 4.23 lit. |

Preparation of Emulsion Em 1-4

Emulsion Em 1-4 was prepared similarly to emulsion Em 1-2, except that solutions (Gr-1) and (G-1) were replaced by the following solutions (Gr-3) and (G-3), respectively; and solutions (S-1) and (H-1) were added for 1 min. in the nucleation stage.

| Gr-3 | |
|---|---|
| Oxidized gelatin (mean molecular weight of ca. 20,000) | 40.62 g |
| Potassium bromide | 12.37 g |
| Distilled water to make | 16.3 lit. |
| G-3 | |
| Succinated gelatin (mean molecular weight of ca. 20,000) | 174.5 g |
| 10 wt % Methanol solution of EO-1*[1] | 5.84 ml |
| Distilled water to make | 4.23 lit. |

Preparation of Emulsion Em 1-5

Emulsion Em 1-5 was prepared similarly to emulsion Em 1-2, except that the pH in the nucleation stage was adjusted to 8.5 and after maintained for 9 min., the pH was adjusted to 5.5 with an aqueous acetic solution.

Preparation of Emulsion Em 1-6

Emulsion Em 1-6 was prepared similarly to emulsion Em 1-2, except that the pH in the nucleation stage was adjusted to 10.2 and after maintained for 5 min., the pH was adjusted to 5.5 with an aqueous acetic solution.

Preparation of Emulsion Em 1-7

Emulsion Em 1-7 was prepared similarly to emulsion Em 1-2, except that solution (H-2) was replaced by solution (H-4).

| H-4 | |
|---|---|
| Alkali-processed inert gelatin (mean molecular weight of ca. 100,000) | 49.2 g |
| Potassium bromide | 796.7 g |
| Potassium iodide | 22.68 g |
| Water to make | 5.47 lit. |

Preparation of Emulsion Em 1-8

Emulsion Em 1-8 was prepared similarly to emulsion Em 1-2, except that in the stage of introducing the high iodide phase, solutions (A-1) and (B-1) were replaced by solution (A-2).

| A-2 | |
|---|---|
| Potassium iodide | 44.05 g |
| Distilled water to make | 530.7 ml |

Preparation of Emulsion Em 1-9

Emulsion Em 1-9 was prepared similarly to emulsion Em 1-2, except that solutions (Gr-1) and (G-1) were replaced by the following solutions (Gr-4) and (G-4), respectively; and aqueous ammonia to be added in the nucleation stage was reduced to ⅕.

| Gr-4 | |
|---|---|
| Oxidized gelatin (mean molecular weight of ca. 20,000 and containing methionine of 8 μmol/g gelatin) | 106.2 g |
| Potassium bromide | 18.47 g |
| Distilled water to make | 18.3 lit. |
| G-4 | |
| Oxidized gelatin (mean molecular weight of ca. 20,000 and containing methionine of 8 μmol/g gelatin) | 78.08 g |
| 10 wt % Methanol solution of EO-1*1 | 5.68 ml |
| Distilled water to make | 1.89 lit. |

Preparation of Emulsion Em 1-10

Emulsion Em 1-10 was prepared similarly to emulsion Em 1-2, except that in the stage of introducing the high iodide phase, solutions (A-1) and (B-1) were replaced by the following solutions (A-3) and (B-3).

| A-3 | |
|---|---|
| Sodium p-iodoacetoamidobenzenesufonate | 153.9 g |
| $H_2O$ | 1230.9 ml |
| B-3 | |
| Sodium sulfite | 53.4 g |
| $H_2O$ | 530.4 ml |

Preparation of Emulsion Em 1-11

Emulsion Em 1-11 was prepared similarly to emulsion Em 1-2, except that in the stage of introducing the high iodide phase, the temperature within the reaction vessel was lowered to 40° C. and the reaction mixture was concentrated to 20.35 lit.

Preparation of Emulsion Em 1-12

Emulsion Em 1-11 was prepared similarly to emulsion Em 1-2, except that concentration by the use of the ultrafiltration apparatus was not conducted throughout the internal region growth stage, the high iodide phase-introducing stage and shell growth stage.

Preparation of Emulsion Em 1-13

Emulsion Em 1-13 was prepared similarly to emulsion Em 1-2, except that in the stage of introducing the high iodide phase, the temperature within the reaction vessel was maintained at 60° C., without being lowered to 40° C.

Preparation of Emulsion Em 1-14

Emulsion Em 1-14 was prepared similarly to emulsion Em 1-2, except that in the shell growth stage, the silver potential of the reaction mixture was maintained at −50 mV using a 1.75 mol/l potassium bromide aqueous solution.

Preparation of Emulsion Em 1-15

Emulsion Em 1-15 was prepared similarly to emulsion Em 1-2, except that 80% of the total silver amount of silver halide grains was consumed in the internal region growth stage.

Preparation of Emulsion Em 1-16

Emulsion Em 1-16 was prepared similarly to emulsion Em 1-2, except that 80% of the total silver amount of silver halide grains was consumed in the internal region growth stage and in the shell growth stage, the silver potential of the reaction mixture was maintained at −30 mV using a 1.75 mol/l potassium bromide aqueous solution.

Preparation of Emulsion Em 1-17

Emulsion Em 1-17 was prepared similarly to emulsion Em 1-2, except that in the shell growth stage, addition rates of solutions (S-1) and (H-1) were made to 0.5 times.

Preparation of Emulsion Em 1-18

Emulsion Em 1-18 was prepared similarly to emulsion Em 1-2, except that prior to addition of solution (A-1) in the stage of introducing the high iodide phase, the silver potential was adjusted to −40 mV using a 1.75 mol/l potassium bromide aqueous solution.

Preparation of Emulsion Em 1-19

Emulsion Em 1-19 was prepared similarly to emulsion Em 1-2, except that after completion of desalting and addition of gelatin, 33.4 g of emulsion Em-A was further added and Ostwald ripening was conducted at 50° C. and 50 mV for 40 min.

The emulsion, Em-A was prepared in the following manner. Thus, to solution (Gr-A) were added solutions (S-A) and (H-A) in 10 min., while the pH was maintained at 2.0 using nitric acid and the temperature was controlled to 30° C. After completion of grain formation, the pH was adjusted to 5.8 using aqueous sodium carbonate solution and the finished weight was 12.0 kg. The emulsion was comprised of fine silver bromide grains having an average size of 0.05 μm.

| Gr-A | |
|---|---|
| Alkali-processed inert gelatin | 465.3 g |
| Potassium bromide | 7.59 g |
| Distilled water to make | 5.0 lit. |
| S-A | |
| Silver nitrate | 1240.7 g |
| Distilled water to make | 2.1 lit. |
| H-A | |
| Potassium bromide | 785.4 g |
| Distilled water to make | 2.1 lit. |

Characteristics of the thus prepared emulsion grains were determined in accordance with the measurement procedure described earlier and results thereof are shown in Table 1. It was proved that in any one of all emulsions except for Em 1-8, at least 50% of the total grain projected area was accounted for by tabular grain containing at least 10 dislocation lines in the peripheral region of the major faces.

To each of the emulsions, Em 1-1 through Em 1-19, sensitizing dyes S-1 and S-2, potassium thiocyanate, chloroauric acid, sodium thiosulfate, and triphenylphosphine selenide were added and chemical sensitization was conducted in accordance with conventional procedure so as to achieve an optimum fog-sensitivity relationship. Subsequently, to each of the emulsions, stabilizer ST-1, and antifoggants AF-1 and AF-2 were added in amounts of 1 g, 3 mg and 20 mg per mol silver halide, respectively.

TABLE 1

| Emulsion No. | ECEL*1 (μm) | Aspect Ratio | Coefficient of Variation (%) Grain Size*2 | Coefficient of Variation (%) Grain Thickness | Average Overall Iodide Content (mol %) | Internal Region Average Iodide Content (%) | Internal Region Shape | Surface Iodide Content (mol %) Overall Surface | Surface Iodide Content (mol %) Side Face | Dislocation Lines Grains (%)*3 | Dislocation Lines Average Length (nm) | Dislocation Lines C.V.*4 (%) |
|---|---|---|---|---|---|---|---|---|---|---|---|---|
| Em 1-1 (Inv.) | 0.5 | 7 | 22 | 35 | 3.0 | 0.8 | Hexagon | 6.5 | 3.2 | More than 50% | 62 | 36 |
| Em 1-2 (Inv.) | 0.5 | 7 | 22 | 35 | 2.5 | 0.0 | Hexagon | 6.5 | 3.2 | More than 50% | 62 | 36 |
| Em 1-3 (Inv.) | 0.5 | 7 | 15 | 35 | 2.5 | 0.0 | Hexagon | 6.5 | 3.2 | More than 50% | 62 | 36 |
| Em 1-4 (Inv.) | 0.5 | 7 | 8 | 35 | 2.5 | 0.0 | Hexagon | 6.5 | 3.2 | More than 50% | 62 | 36 |
| Em 1-5 (Inv.) | 0.5 | 7 | 22 | 15 | 2.5 | 0.0 | Hexagon | 6.5 | 3.2 | More than 50% | 62 | 36 |
| Em 1-6 (Inv.) | 0.5 | 7 | 22 | 43 | 2.5 | 0.0 | Hexagon | 6.5 | 3.2 | More than 50% | 62 | 36 |
| Em 1-7 (Comp.) | 0.5 | 7 | 22 | 35 | 3.9 | 2.2 | Hexagon | 6.5 | 3.2 | More than 50% | 62 | 36 |
| Em 1-8 (Inv.) | 0.5 | 7 | 22 | 35 | 2.5 | 0.0 | Hexagon | 6.5 | 3.2 | Less than 50% | 62 | 36 |
| Em 1-9 (Inv.) | 0.5 | 12 | 25 | 18 | 2.5 | 0.0 | Hexagon | 6.5 | 3.1 | More than 50% | 63 | 36 |
| Em 1-10 (Inv.) | 0.5 | 7 | 22 | 35 | 4.0 | 0.0 | Hexagon | 9.2 | 4.2 | More than 50% | 62 | 36 |
| Em 1-11 (Inv.) | 0.5 | 7 | 22 | 35 | 2.5 | 0.0 | Hexagon | 7.4 | 3.2 | More than 50% | 62 | 36 |
| Em 1-12 (Inv.) | 0.5 | 7 | 22 | 35 | 2.5 | 0.0 | Hexagon | 8.2 | 3.2 | More than 50% | 62 | 36 |
| Em 1-13 (Inv.) | 0.5 | 7 | 22 | 35 | 2.5 | 0.0 | Circle | 6.5 | 3.2 | More than 50% | 62 | 36 |
| Em 1-14 (Inv.) | 0.5 | 7 | 22 | 35 | 2.5 | 0.0 | Hexagon | 6.5 | 3.1 | More than 50% | 70 | 36 |
| Em 1-15 (Inv.) | 0.5 | 7 | 22 | 35 | 2.5 | 0.0 | Hexagon | 7.5 | 4.2 | More than 50% | 30 | 36 |
| Em 1-16 (Inv.) | 0.5 | 7 | 22 | 35 | 2.5 | 0.0 | Hexagon | 7.5 | 4.2 | More than 50% | 20 | 36 |
| Em 1-17 (Inv.) | 0.5 | 7 | 22 | 35 | 2.5 | 0.0 | Hexagon | 6.5 | 3.2 | More than 50% | 62 | 15 |
| Em 1-18 (Inv.) | 0.5 | 7 | 22 | 35 | 2.5 | 0.0 | Hexagon | 6.5 | 3.2 | More than 50% | 62 | 36 |
| Em 1-19 (Inv.) | 0.5 | 7 | 22 | 35 | 2.5 | 0.0 | Hexagon | 6.5 | 1.8 | More than 50% | 62 | 36 |

*1Average equivalent cube edge length
*2Grain size, expressed in equivalent circle diameter
*3Proportion of grains having at least 10 dislocation lines in the peripheral region of the major faces, expressed in % of the total grain projected area
*4Coefficient of variation of dislocation line length In the Tables, hereinafter, "Aspect Ratio" represents an aspect ratio value at 50% of the cumulative grain projected area, when the aspect ratio for total grains is represented in terms of the aspect ratio of a grain (ordinate) and the cumulative grain projected area (abscissa, from 0 to 100%). In Em 1-1 of Table 1, for example, the aspect ratio was 7 at 50% of the cumulative grain projected area, i.e., it means that 50% of the total grain projected was accounted for by grains having an aspect ratio of not less than 7.

Preparation of Silver Halide Photographic Material

To each of the emulsion obtained as above, a dispersion of coupler C-1 was added and further thereto, photographic additives such as a coating aid and hardener were optimally added to prepare a coating solution. The thus obtained coating solutions were each coated on a subbed, 120 μm thick triacetyl cellulose support using a slide coater and dried to obtain samples No. 101 through 109.

Sensitizing Dye S-1

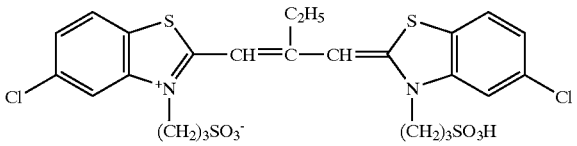

Sensitizing Dye S-2

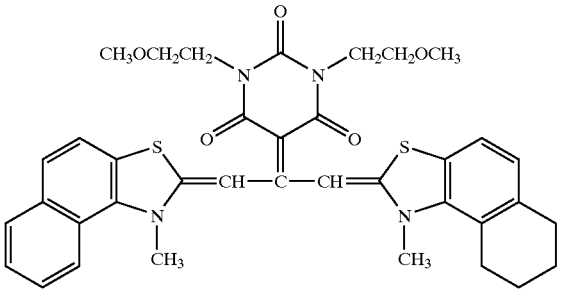

Coupler C-1

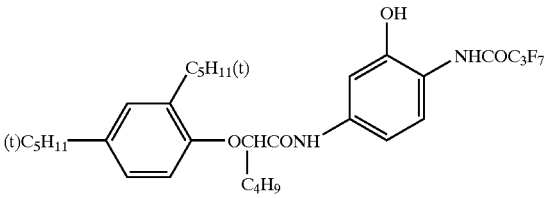

ST-1

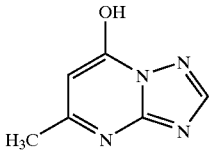

AF-1

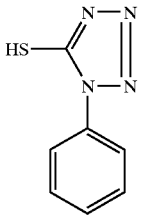

AF-2

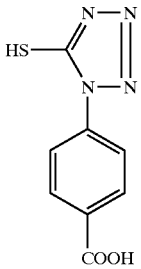

Exposure and Processing

The thus prepared photographic material samples each were exposed to light for 1/100 sec. through TOSHIBA glass filter 0-56 and an optical wedge using a 5400K light source, and processed according to the following procedure.

Process-1

| Step | Temperature | Time |
|---|---|---|
| First developing | 4 min. | 38° C. |
| Washing | 2 min. | 38° C. |
| Reversal | 2 min. | 38° C. |
| Color developing | 6 min. | 38° C. |
| Adjusting | 2 min. | 38° C. |
| Bleaching | 6 min. | 38° C. |
| Fixing | 4 min. | 38° C. |
| Washing | 4 min. | 38° C. |
| stabilizing | 1 min. | ordinary temperature |
| Drying | | |

Processing solutions used in the above steps are as follows.

| | |
|---|---|
| **First Developer Solution** | |
| Sodium tetrapolyphosphate | 2 g |
| Sodium sulfite | 20 g |
| Hydroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 10 ml |
| Water was added to make 1000 ml (and pH of 9.60) | |
| **Reversal Solution** | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| **Color Developer Solution** | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| 2,2-Ethylendithioethanol | 1 g |
| Water to make 1000 ml (pH of 11.70) | |
| **Conditioner** | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| **Bleaching Solution** | |
| Sodium ethylenediaminetertaacetate (dihydrate) | 2 g |
| Ammonium ferric ethylenediaminetertaacetate (dihydrate) | 120 g |
| Potassium bromide | 100 g |
| Water to make 1000 ml (pH of 5.56) | |
| **Fixer Solution** | |
| Ammonium thiosulfate | 80 g |
| Sodium sulfite | 5 g |
| Sodium bisulfite | 5 g |
| Water to make 1000 ml (pH of 6.60) | |

-continued

| Stabilizer Solution | |
|---|---|
| Formalin (37 wt %) | 5 ml |
| KONIDUCKS (available from Konica Corp.) | 5 ml |
| Water to make 1000 ml (pH of 7.00) | |

Process-2

Process-2 was conducted similarly to the foregoing Process-1, except that the first developing time was varied from 4 min. to 6 min.

Evaluation of Characteristics

Exposed samples were subjected to the foregoing process-1 or process-2 and evaluated with respect to sensitivity, contrast and forced developability in accordance with the following procedure.

Densitometry

Processed samples were each subjected to densitometry using densitometer Status A (available from X-Rite Co.) to prepare a characteristic curve comprised of an ordinate of cyan density and an abscissa of exposure (LogE).

Sensitivity ($S_1$)

Sensitivity (S) was defined as the reciprocal of exposure giving a cyan density of 0.5 on the characteristic curve described above and the sensitivity obtained in the process-1 was represented in terms of $S_1$. The sensitivity ($S_1$) was also represented by a relative value, based on the sensitivity of sample No. 1 being 1.00.

Contrast ($\Delta G$)

On the characteristic curve, a value of a cyan density at an exposure of 1/10 of exposure giving a cyan density of 0.5 minus 0.5 was defined as contrast (denoted as $\Delta G$). The thus obtained $\Delta G$ values were represented by a relative value, based on the contrast $\Delta G$ of sample No. 110 being 1.00. The larger G is the higher contrast, indicating a silver halide emulsion having a high contrast characteristic.

Forced developability: $\Delta S_T$

Contrasts were obtained in the process-1 and process-2, which were denoted as $\Delta G_1$ and $\Delta G_2$, respectively, and forced developability ($\Delta S_T$) was represented as a ratio of $\Delta G_2$ to $\Delta G_1$, as defined below:

$$\Delta S_T = \Delta G_2(\text{process-2})/\Delta G_1(\text{process-1}).$$

This is a measure indicating contrast variation for variation in first development time, and the value closer to 1 indicates higher forced developability. This forced developability was represented a relative value, based on the $\Delta S_T$ of sample No. 105 being 1.00.

The thus obtained evaluation results are shown in Table 2.

TABLE 2

| Sample No. | Emulsion No. | $\Delta S_1$ | $\Delta G$ | $\Delta S_T$ |
|---|---|---|---|---|
| 101 | Em 1-1 | 1.00 | 1.25 | 1.09 |
| 102 | Em 1-2 | 1.10 | 1.40 | 1.05 |
| 103 | Em 1-3 | 1.10 | 1.50 | 1.03 |
| 104 | Em 1-4 | 1.10 | 1.60 | 1.00 |
| 105 | Em 1-5 | 1.10 | 1.60 | 1.00 |
| 106 | Em 1-6 | 1.00 | 1.25 | 1.09 |
| 107 | Em 1-7 | 0.70 | 0.60 | 1.50 |
| 108 | Em 1-8 | 0.95 | 0.90 | 1.15 |
| 109 | Em 1-9 | 1.20 | 1.50 | 1.03 |
| 110 | Em 1-10 | 1.00 | 1.00 | 1.12 |
| 111 | Em 1-11 | 1.05 | 1.30 | 1.08 |
| 112 | Em 1-12 | 1.00 | 1.10 | 1.10 |
| 113 | Em 1-13 | 1.10 | 1.10 | 1.10 |
| 114 | Em 1-14 | 1.00 | 1.10 | 1.10 |
| 115 | Em 1-15 | 1.10 | 1.40 | 1.05 |
| 116 | Em 1-16 | 1.00 | 1.00 | 1.12 |
| 117 | Em 1-17 | 1.10 | 1.60 | 1.00 |
| 118 | Em 1-18 | 1.10 | 1.60 | 1.00 |
| 119 | Em 1-19 | 1.15 | 1.40 | 1.05 |

As apparent from Table 2, it was proved that the inventive samples using the inventive emulsions exhibited enhanced density, higher contrast and superior forced developability compared to samples No. 1-7 using the comparative emulsion Em 1-7. Specifically, from comparison of samples 101 and 102, it was proved that the use of emulsion (Em 1-2) containing no iodide in the internal region led to further improved results. As apparent from comparison of samples Nos. 102 to 104, enhanced monodispersity of grain size (equivalent circle diameter) of the emulsions Em 1-3 and Em 1-4 resulted in further marked improvements; as apparent from comparison of sample Nos. 102, 105 and 106 using emulsions Em 1-2, Em 1-5 and Em 1-6, enhanced homogeneity in grain thickness (Em 1-5) resulted further marked improvements; as apparent from comparison of sample Nos. 102 and 108, closer presence of dislocation lines in the peripheral region (Em 1-2) resulted in marked improvements. It was also proved that as apparent from comparison of sample Nos. 102 and 109, the higher aspect ratio (Em 1-9) led to further improved results; and as apparent from sample Nos. 102 and 110 using emulsions Em 1-2 and Em 1-10, the lower average iodide content (Em 1-2) led to further improved results; as apparent from comparison of sample Nos. 102, 111 and 112 using emulsions Em 1-2, Em 1-11 and Em 1-12, a decreased surface iodide content (Em 1-12) led to further improved results; as apparent from sample No. 119 using emulsion Em 1-19, a decreased side-face iodide content led to further improved results. As apparent from comparison of sample Nos. 102 and 113, the internal region being hexagonal (Em 1-13) led to further improved results; as apparent from comparison of sample Nos. 102, 114 to 116, in cases when the average dislocation line length was longer Em 1-14) or shorter (Em 1-15 and 1-16), improvement effects were reduced; as apparent from comparison of sample Nos. 102 and 117, enhanced uniformity in dislocation line length (Em 1-17) led to further improved results; and as apparent from sample No. 118, localization of dislocation lines in corners of the major faces of the grain (Em 1-18) led to improved results similar to the case of the enhanced uniformity in dislocation line length.

Example 2

Preparation of Emulsion Em 2-1

Silver halide emulsion Em 2-1 was prepared similarly to emulsion Em 1-19 of Example 1, except that emulsion Em-A was replaced by emulsion Em-B, as prepared in the following manner.

Preparation of Emulsion Em-B:

Emulsion Em-B was prepared similarly to Em-A of Example 1, except that $4.045\times10^{-3}$ mol of $K_2IrCl_6$ was added to solution (H-A).

Preparation of Emulsion Em 2-2

Emulsion Em 2-2 was prepared similarly to emulsion Em 1-19 of Example 1, except that emulsion Em-A was replaced by emulsion Em-C, as prepared in the following manner.

Preparation of Emulsion Em-C:

Emulsion Em-B was prepared similarly to Em-A of Example 1, except that $1.0\times10^{-4}$ mol of $K4[Ir(CN)_6]$ was added to solution (H-A).

Preparation of Silver Halide Photographic Material

Similarly to Example 1, emulsions Em 2-1 and 2-2, and were each subjected to chemical sensitization, and these emulsions and emulsion Em 1-19 of Example 1 were respectively coated and dried to obtain photographic material sample Nos. 201, 202 and 203, respectively.

Evaluation of Characteristics

Similarly to Example 1, the thus prepared samples were subjected to the foregoing exposure and the process-1 or process-2 and evaluated with respect to sensitivity, contrast and forced developability in accordance with the procedure described in Example 1. Results thereof are shown in Table 3. Sensitivity ($S_1$) and contrast ($\Delta G$) were each represented by a relative value, based on those of sample No. 203 being 1.00. Furthermore, samples were evaluated with respect to reciprocity law failure of intensity.

Reciprocity Law Failure

Samples were exposed for 8 sec or 1/10000 sec. and subjected to process-1. Sensitivity (S) was defined as the reciprocal of exposure giving a cyan density of 0.5 on the characteristic curve, and the sensitivity of 8 sec exposure and that of 1/10000 sec exposure were denoted as $S_3$ and $S_4$, respectively. The sensitivity ($S_1$) was represented by a relative value, based on the sensitivity of sample No. 203 being 1.00. Sensitivities ($S_3$ and $S_4$) were represented by a relative value, based on the sensitivity ($S_1$). The less difference from $S_1$ is the less sensitivity variation for variation of exposure time, indicating the less reciprocity law failure with respect to intensity.

TABLE 3

| Sample No. | Emulsion | $S_1$ | $S_3$ | $S_4$ | $\Delta G$ | $\Delta S_T$ |
|---|---|---|---|---|---|---|
| 201 | Em 2-1 | 1.30 | 1.27 | 1.32 | 1.40 | 1.05 |
| 202 | Em 2-2 | 1.40 | 1.39 | 1.42 | 1.40 | 1.05 |
| 203 | Em 1-19 | 1.00 | 0.90 | 1.07 | 1.00 | 1.12 |

As can be seen from As apparent from Table 3, it was proved that samples Nos. 201 and 202 using the emulsion comprised of grains including a polyvalent metal compound in the low iodide region of the side-face (Em 2-1 and 2-2) were superior in sensitivity, contrast and forced developability. Specifically, it was noted that inclusion of the polyvalent metal compound led to markedly improved results in sensitization and reciprocity law failure.

Example 3

Preparation of Silver Halide Emulsion Em 3-1

Nucleation Stage

Mother liquor (Gr-31), as shown below, within a reaction vessel was maintained at 30° C. with stirring at a rate of 400 rpm, using a mixing stirrer described JP-A No. 62-160128 and the pH was adjusted to 1.96 using 0.5 mol/l sulfuric acid solution. Thereafter, the following solutions (S-31) and (H-31) were added by double jet addition at a constant flow rate over a period of 1 min. to perform nucleation. In this addition, 3% of the total amount of solution (S-1) was used.

| | |
|---|---|
| Gr-31 | |
| Alkali-processed inert gelatin | 38.11 g |
| Potassium bromide | 11.61 g |
| Distilled water to make | 15.2 lit. |
| S-31 | |
| Silver nitrate | 900.0 g |
| Distilled water to make | 4.24 lit. |
| H-31 | |
| Potassium bromide | 433.6 g |
| Distilled water to make | 2.92 lit. |

Ripening Stage

After completion of the foregoing nucleation, the following solution (G-31) was added thereto and the temperature was raised to 60° C. in 30 min., while maintaining the silver halide emulsion within the reaction vessel at 0 mV of a silver potential, which was measured by a silver ion selection electrode and a saturated silver—silver chloride electrode as a reference electrode, using an aqueous 1.75 mol/l potassium bromide solution. Subsequently, an aqueous ammonia solution was added thereto and the pH was adjusted to 9.3 with a 1 mol/l potassium hydroxide solution and after being maintained for 7 min., the pH was adjusted to 5.5 using an aqueous acetic acid solution, while the silver potential was maintained at 0 mV using an aqueous 1.75 mol/l potassium bromide solution.

| | |
|---|---|
| G-31 | |
| Alkali-processed inert gelatin (mean molecular weight of ca. 100,000) | 163.6 g |
| 10 wt % Methanol solution of EO-1 | 5.49 ml |
| Distilled water to make | 3.97 lit. |

Growth Stage of Internal Region

After completion of the foregoing ripening stage, subsequently, solution (S-31) described above and solution (H-32) were added by double jet addition at an accelerated flow rate (approximately 6 times from start to finish) over a period of 90 min., while the silver potential was maintained at +6 mV using an aqueous 1.75 mol/l potassium bromide solution. In this stage, 65% of the total amount of solution (S-31) was used, i.e., 68% of the total silver amount of final silver halide grains was consumed from the nucleation stage to this stage.

| | |
|---|---|
| H-32 | |
| Alkali-processed inert gelatin (mean molecular weight of ca. 100,000) | 30.6 g |
| Potassium bromide | 450.3 g |
| Potassium iodide | 6.35 g |
| Water to make | 3.06 lit. |

Introduction of High Iodide Phase and Shell Growth

After completion of growth of the internal region, the temperature within the reaction vessel was lowered to 40° C. and reaction mixture was concentrated to 7.15 lit., using an ultrafiltration apparatus. Thereafter, solution (A-31) was added and solution (B-31) was subsequently added, then, the pH was adjusted to 9.3 with an aqueous 1 mol/l potassium hydroxide solution and ripening was conducted over period of 9 min. to release iodide ions. Thereafter, the pH was adjusted to 5.5 with an aqueous acetic acid solution and the silver potential was adjusted to −40 mV using an aqueous 1.75 mol/l potassium bromide solution, subsequently, solutions (S-31) and (H-31) described above were added at an accelerated flow rate, while the reaction mixture was maintained at a constant volume until completion of the growth stage, using the ultrafiltration apparatus.

| | |
|---|---|
| A-31 | |
| Sodium p-iodoacetoamidobenzenesufonate | 61.6 g |
| $H_2O$ | 581.8 ml |
| B-31 | |
| Sodium sulfite | 21.4 g |
| $H_2O$ | 320.6 ml |

After completion of the foregoing grain growth, desalting was carried out in accordance with the method described in JP-A 5-72658, gelatin was added and dispersed, then, the pH and pAg were adjusted to 5.80 and 8.80, respectively, to obtain emulsion Em 3-1.

Preparation of Emulsion Em 3-2

Emulsion Em 3-2 was prepared similarly to emulsion Em 3-1, except that solution (H-32) was replaced by solution (H-33).

| | |
|---|---|
| H-33 | |
| Alkali-processed inert gelatin (mean molecular weight of ca. 100,000) | 30.6 g |
| Potassium bromide | 454.9 g |
| Water to make | 3.06 lit. |

Preparation of Emulsion Em 3-3

Emulsion Em 3-3 was prepared similarly to emulsion Em 3-2, except that solutions (Gr-31) and (G-31) were replaced by the following solutions (Gr-32) and (G-32), respectively; and solutions (S-31) and (H-31) were added for 1 min. in the nucleation stage.

| | |
|---|---|
| Gr-32 | |
| Alkali-processed inert gelatin | 54.44 g |
| Potassium bromide | 16.59 g |
| Distilled water to make | 21.8 lit. |
| G-32 | |
| Alkali-processed inert gelatin (mean molecular weight of ca. 100,000) | 233.7 g |
| 10 wt % Methanol solution of EO-1*1 | 7.84 ml |
| Distilled water to make | 5.67 lit. |

Preparation of Emulsion Em 3-4

Emulsion Em 3-4 was prepared similarly to emulsion Em 3-2, except that solutions (Gr-31) and (G-31) were replaced by the following solutions (Gr-33) and (G-33), respectively; and solutions (S-31) and (H-31) were added for 1 min. in the nucleation stage.

| | |
|---|---|
| Gr-33 | |
| Oxidized gelatin (mean molecular weight of ca. 20,000) | 38.11 g |
| Potassium bromide | 11.61 g |
| Distilled water to make | 15.2 lit. |
| G-33 | |
| Succinated gelatin (mean molecular weight of ca. 20,000) | 163.6 g |
| 10 wt % Methanol solution of EO-1*1 | 5.49 ml |
| Distilled water to make | 3.97 lit. |

Preparation of Emulsion Em 3-5

Emulsion Em 3-5 was prepared similarly to emulsion Em 3-2, except that the pH in the nucleation stage was adjusted to 8.5 and after being maintained for 9 min., the pH was adjusted to 5.5 with an aqueous acetic solution.

Preparation of Emulsion Em 3-6

Emulsion Em 3-6 was prepared similarly to emulsion Em 3-2, except that the pH in the nucleation stage was adjusted to 10.2 and after maintained for 5 min., the pH was adjusted to 5.5 with an aqueous acetic solution.

Preparation of Emulsion Em 3-7

Emulsion Em 3-7 was prepared similarly to emulsion Em 3-2, except that solution (H-32) was replaced by solution (H-34).

| | |
|---|---|
| H-34 | |
| Alkali-processed inert gelatin (mean molecular weight of ca. 100,000) | 30.6 g |
| Potassium bromide | 444.9 g |
| Potassium iodide | 13.96 g |
| Water to make | 3.06 lit. |

Preparation of Emulsion Em 3-8

Emulsion Em 3-8 was prepared similarly to emulsion Em 3-2, except that in the stage of introducing the high iodide phase, solutions (A-31) and (B-31) were replaced by solution (A-32).

| | |
|---|---|
| A-32 | |
| Potassium iodide | 28.14 g |
| Distilled water to make | 339.0 ml |

Preparation of Emulsion Em 3-9

Emulsion Em 3-9 was prepared similarly to emulsion Em 3-2, except that solutions (Gr-31) and (G-31) were replaced by the following solutions (Gr-34) and (G-34), respectively; and aqueous ammonia to be added in the nucleation stage was reduced to ⅕.

| | |
|---|---|
| Gr-34 | |
| Oxidized gelatin (mean molecular weight of ca. 20,000 and containing methionine of 8 μmol/g gelatin) | 141.6 g |
| Potassium bromide | 24.62 g |
| Distilled water to make | 24.4 lit. |

-continued

| G-34 | |
|---|---|
| Oxidized gelatin (mean molecular weight of ca. 20,000 and containing methionine of 8 μmol/g gelatin) | 104.1 mg |
| 10 wt % Methanol solution of EO-1*1 | 7.57 ml |
| Distilled water to make | 2.52 lit. |

Preparation of Emulsion Em 3-10

Emulsion Em 3-10 was prepared similarly to emulsion Em 3-2, except that in the stage of introducing the high iodide phase, solutions (A-31) and (B-31) were replaced by the following solutions (A-33) and (B-33).

| A-33 | |
|---|---|
| Sodium p-iodoacetoamidobenzenesufonate | 76.9 g |
| $H_2O$ | 727.2 ml |
| B-33 | |
| Sodium sulfite | 26.7 g |
| $H_2O$ | 400.8 ml |

Preparation of Emulsion Em 3-11

Emulsion Em 3-11 was prepared similarly to emulsion Em 3-2, except that in the stage of introducing the high iodide phase, the temperature within the reaction vessel was lowered to 40° C. and the reaction mixture was concentrated to 16.3 lit.

Preparation of Emulsion Em 3-12

Emulsion Em 3-11 was prepared similarly to emulsion Em 3-2, except that concentration by the use of the ultrafiltration apparatus was not conducted throughout the internal region growth stage, the high iodide phase-introducing stage and shell growth stage.

Preparation of Emulsion Em 3-13

Emulsion Em 3-13 was prepared similarly to emulsion Em 3-2, except that in the stage of introducing the high iodide phase, the temperature within the reaction vessel was maintained at 60° C., without being lowered to 40° C.

Preparation of Emulsion Em 3-14

Emulsion Em 3-14 was prepared similarly to emulsion Em 3-2, except that 45% of the total silver amount of silver halide grains was consumed in the internal region growth stage.

Preparation of Emulsion Em 3-15

Emulsion Em 3-15 was prepared similarly to emulsion Em 3-2, except that in the shell growth stage, addition rates of solutions (S-31) and (H-31) were made to 0.5 times.

Preparation of Emulsion Em 3-16

Emulsion Em 3-16 was prepared similarly to emulsion Em 3-2, except that prior to addition of solution (A-31) in the stage of introducing the high iodide phase, the silver potential was adjusted to −40 mV using a 1.75 mol/l potassium bromide aqueous solution.

Preparation of Emulsion Em 3-17

Emulsion Em 3-17 was prepared similarly to emulsion Em 3-2, except that after completion of desalting and addition of gelatin, 23.9 g of emulsion Em-A was further added and Ostwald ripening was conducted at 50° C. and 50 mV for 40 min.

Grain characteristics of the thus prepared emulsions were determined in accordance with the measurement procedure described earlier and results thereof are shown in Table 4.

TABLE 1

| Emulsion No. | ECEL*1 (μm) | Aspect Ratio | Coefficient of Variation (%) Grain Size*2 | Coefficient of Variation (%) Grain Thickness | Average Overall Iodide Content (mol %) | Internal Region Average Iodide Content (%) | Internal Region Shape | Surface Iodide Content (mol %) Overall Surface | Surface Iodide Content (mol %) Side Face | Dislocation Lines Grains (%)*3 | Dislocation Lines Average Length (nm) | Dislocation Lines C.V.*4 (%) |
|---|---|---|---|---|---|---|---|---|---|---|---|---|
| Em 3-1 (Inv.) | 0.36 | 5 | 24 | 35 | 3.8 | 1.0 | Hexagon | 7.3 | 4.1 | More than 50% | 40 | 32 |
| Em 3-2 (Inv.) | 0.36 | 5 | 24 | 35 | 3.2 | 0.0 | Hexagon | 7.3 | 4.1 | More than 50% | 40 | 32 |
| Em 3-3 (Inv.) | 0.36 | 5 | 15 | 35 | 3.2 | 0.0 | Hexagon | 7.3 | 4.1 | More than 50% | 40 | 32 |
| Em 3-4 (Inv.) | 0.36 | 5 | 8 | 35 | 3.2 | 0.0 | Hexagon | 7.3 | 4.1 | More than 50% | 40 | 32 |
| Em 3-5 (Inv.) | 0.36 | 5 | 24 | 15 | 3.2 | 0.0 | Hexagon | 7.3 | 4.1 | More than 50% | 40 | 32 |
| Em 3-6 (Inv.) | 0.36 | 5 | 24 | 42 | 3.2 | 0.0 | Hexagon | 7.3 | 4.1 | More than 50% | 40 | 32 |
| Em 3-7 (Comp.) | 0.36 | 5 | 24 | 35 | 4.5 | 2.2 | Hexagon | 7.3 | 4.1 | More than 50% | 40 | 32 |
| Em 3-8 (Inv.) | 0.36 | 5 | 24 | 35 | 3.2 | 0.0 | Hexagon | 7.3 | 4.1 | Less than 50% | 40 | 32 |
| Em 3-9 (Inv.) | 0.36 | 10 | 25 | 18 | 3.2 | 0.0 | Hexagon | 7.3 | 3.9 | More than 50% | 40 | 32 |
| Em 3-10 (Inv.) | 0.36 | 5 | 24 | 35 | 4.0 | 0.0 | Hexagon | 11.0 | 5.3 | More than 50% | 40 | 32 |
| Em 3-11 (Inv.) | 0.36 | 5 | 24 | 35 | 3.2 | 0.0 | Hexagon | 9.4 | 4.1 | More than 50% | 40 | 32 |
| Em 3-12 (Inv.) | 0.36 | 5 | 24 | 35 | 3.2 | 0.0 | Hexagon | 11.0 | 4.1 | More than 50% | 40 | 32 |

TABLE 1-continued

| Emulsion No. | ECEL*1 (μm) | Aspect Ratio | Coefficient of Variation (%) Grain Size*2 | Coefficient of Variation (%) Grain Thickness | Average Overall Iodide Content (mol %) | Internal Region Average Iodide Content (%) | Internal Region Shape | Surface Iodide Content (mol %) Overall Surface | Surface Iodide Content (mol %) Side Face | Dislocation Lines Grains (%)*3 | Dislocation Lines Average Length (nm) | Dislocation Lines C.V.*4 (%) |
|---|---|---|---|---|---|---|---|---|---|---|---|---|
| Em 3-13 (Inv.) | 0.36 | 5 | 24 | 35 | 3.2 | 0.0 | Circle | 7.3 | 4.1 | More than 50% | 40 | 32 |
| Em 3-14 (Inv.) | 0.36 | 5 | 24 | 35 | 3.2 | 0.0 | Hexagon | 7.3 | 4.1 | More than 50% | 75 | 32 |
| Em 3-15 (Inv.) | 0.36 | 5 | 24 | 35 | 3.2 | 0.0 | Hexagon | 7.3 | 4.1 | More than 50% | 40 | 32 |
| Em 3-16 (Inv.) | 0.36 | 5 | 24 | 35 | 3.2 | 0.0 | Hexagon | 7.3 | 4.1 | More than 50% | 40 | 32 |
| Em 3-17 (Inv.) | 0.36 | 5 | 24 | 35 | 3.2 | 0.0 | Hexagon | 7.3 | 2.2 | More than 50% | 40 | 32 |

*1Average equivalent cube edge length

*2Grain size, expressed in equivalent circle diameter

*3Proportion of grains having at least 10 dislocation lines in the peripheral region of the major faces, expressed in % of the total grain projected area

*4Coefficient of variation of dislocation line length

As can be seen from Table 4, Em 3-3 was comprised of an internal region containing no iodide; Em 3-3 and 3-4 exhibited enhanced homogeneity of the grain size distribution; homogeneity in grain thickness was enhanced in Em 3-5 and on the contrary, was lowered in Em 3-6; Em 3-7 was comprised of an internal region containing relatively high iodide; Em 3-8 exhibited a less proportion of grains having at least 10 dislocation lines; Em 3-9 was accounted for by grains having relatively high aspect ratios; Em 3-10 contained relatively high iodide; Em 3-11 and 3-12 had a relatively high surface iodide content; Em 3-13 was comprised of a non-hexagonal internal region; Em 3-14 contained relatively long dislocation lines; Em 3-15 exhibited enhanced homogeneity of dislocation line length; in Em 3-16, the dislocation lines were concentrated to corner portions of the major faces; and Em 3-17 exhibited a relatively low surface iodide on the side face.

Preparation of Silver Halide Photographic Material

Similarly to Example 1, emulsions Em 3-1 through 3-17 were each subjected to chemical sensitization, coated and dried to obtain photographic material sample Nos. 301 through 317, respectively.

Evaluation of Characteristics

Similarly to Example 1, samples were subjected to the foregoing exposure and the process-1 or process-2 and evaluated with respect to sensitivity, contrast and forced developability in accordance with the procedure described in Example 1. Results thereof are shown in Table 5. Sensitivity ($S_1$), contrast (ΔG) and forced developability ($\Delta S_t$) were each represented by a relative value, based on those of sample No. 310 being 1.00.

TABLE 5

| Sample No. | Emulsion No. | $S_1$ | ΔG | $\Delta S_T$ |
|---|---|---|---|---|
| 301 | Em 3-1 | 1.00 | 1.40 | 1.05 |
| 302 | Em 3-2 | 1.20 | 1.50 | 1.03 |

TABLE 5-continued

| Sample No. | Emulsion No. | $S_1$ | ΔG | $\Delta S_T$ |
|---|---|---|---|---|
| 303 | Em 3-3 | 1.20 | 1.65 | 1.01 |
| 304 | Em 3-4 | 1.20 | 1.75 | 1.00 |
| 305 | Em 3-5 | 1.20 | 1.75 | 1.00 |
| 306 | Em 3-6 | 1.00 | 1.40 | 1.05 |
| 307 | Em 3-7 | 0.65 | 0.55 | 1.50 |
| 308 | Em 3-8 | 0.95 | 0.90 | 1.05 |
| 309 | Em 3-9 | 1.30 | 1.65 | 1.01 |
| 310 | Em 3-10 | 1.00 | 1.00 | 1.12 |
| 311 | Em 3-11 | 1.15 | 1.45 | 1.04 |
| 312 | Em 3-12 | 1.00 | 1.20 | 1.08 |
| 313 | Em 3-13 | 1.20 | 1.20 | 1.08 |
| 314 | Em 3-14 | 1.00 | 1.00 | 1.12 |
| 315 | Em 3-15 | 1.20 | 1.75 | 1.00 |
| 316 | Em 3-16 | 1.20 | 1.75 | 1.00 |
| 317 | Em 3-17 | 1.25 | 1.50 | 1.03 |

As apparent from Table 5, similarly to Example 1, the samples using emulsions according to the invention were superior in sensitivity, contrast and forced developability, as compared to sample No. 307 using comparative emulsion Em 3-7. Specifically, it is noted that comparing to the results in Example 1 (Table 2), samples of this Example, in which smaller grain size emulsions were used were further marked in improvement effects of the invention.

Example 4

Preparation of Silver Halide Emulsion Em 4-1

Nucleation Stage

Mother liquor (Gr-41), as shown below, within a reaction vessel was maintained at 30° C. with stirring at a rate of 400 rpm, using a mixing stirrer described JP-A No. 62-160128 and the pH was adjusted to 1.96 using 0.5 mol/l sulfuric acid solution. Thereafter, the following solutions (S-41) and (H-41) were added by double jet addition at a constant flow rate over a period of 1 min. to perform nucleation.

| Gr-41 | |
|---|---|
| Alkali-processed inert gelatin | 30.50 g |
| Potassium bromide | 9.30 g |
| Distilled water to make | 12.2 lit. |
| S-41 | |
| Silver nitrate | 1800.0 g |
| Distilled water to make | 8.48 lit. |
| H-41 | |
| Potassium bromide | 500.0 g |
| Distilled water to make | 3.36 lit. |

Ripening Stage

After completion of the foregoing nucleation, the following solution (G-41) was added thereto and the temperature was raised to 60° C. in 30 min., while maintaining the silver halide emulsion within the reaction vessel at +6 mV of a silver potential, which was measured by a silver ion selection electrode and a saturated silver—silver chloride electrode as a reference electrode, using an aqueous 1.75 mol/l potassium bromide solution. Subsequently, an aqueous ammonia solution was added thereto and the pH was adjusted to 9.3 with a 1 mol/l potassium hydroxide solution and after being maintained for 7 min., the pH was adjusted to 5.0 using an aqueous acetic acid solution, while the silver potential was maintained at +6 mV using an aqueous 1.75 mol/l potassium bromide solution.

| G-41 | |
|---|---|
| Alkali-processed inert gelatin (mean molecular weight of ca. 100,000) | 131.0 g |
| 10 wt % Methanol solution of EO-1*[1] | 4.40 ml |
| Distilled water to make | 3.18 lit. |

*[1]EO-1: $HO(CH_2CH_2O)_m(C(CH_3)HCH_2O)_{19.8}(CH_2CH_2O)_nH$ (m + n = 9.77)

Growth Stage of Internal Region

After completion of the foregoing ripening stage, subsequently, solution (S-41) described above and solution (H-42) were added by double jet addition at an accelerated flow rate (approximately 9 times from start to finish) over a period of 90 min., while the silver potential was maintained at +6 mV using an aqueous 1.75 mol/l potassium bromide solution. Until these stages, 70% of the total silver amount of final silver halide grains was consumed.

| H-42 | |
|---|---|
| Potassium bromide | 485.0 g |
| Potassium iodide | 20.92 g |
| Water to make | 6.72 lit. |

Introduction of High Iodide Phase and Shell Growth

After completion of growth of the internal region, solution (A-41) was added and solution (B-41) was subsequently added, then, the pH was adjusted to 9.3 with an aqueous 1 mol/l potassium hydroxide solution and ripening was conducted over period of 9 min. to release iodide ions. Thereafter, the pH was adjusted to 5.0 with an aqueous acetic acid solution and the silver potential was adjusted to −25 mV using an aqueous 1.75 mol/l potassium bromide solution, subsequently, solutions (S-41) and (H-41) described above were added at an accelerated flow rate.

| A-41 | |
|---|---|
| Sodium p-iodoacetoamidobenzenesufonate | 96.2 g |
| $H_2O$ | 961.8 ml |
| B-41 | |
| Sodium sulfite | 33.4 g |
| $H_2O$ | 513.6 ml |

After completion of the foregoing grain growth, desalting was carried out in accordance with the method described in JP-A 5-72658, gelatin was added and dispersed, then, the pH and pAg were adjusted to 5.80 and 8.80, respectively, to obtain emulsion Em 4-1.

Preparation of Emulsion Em 4-2

Emulsion Em 4-2 was prepared similarly to emulsion Em 4-1, except that solution (H-42) was replaced by solution (H-43) and the high iodide phase was introduced after aqueous silver nitrate solution (S-41) was added in an amount corresponding to 50% of the total silver amount.

| H-43 | |
|---|---|
| Potassium bromide | 495.0 g |
| Potassium iodide | 6.97 g |
| Water to make | 6.72 lit. |

Preparation of Emulsion Em 4-3

Emulsion Em 4-3 was prepared similarly to Em 4-1, except that solution (H-42) was replaced by solution (H-43) and the silver potential (hereinafter, also denoted as EAg) was maintained at +20 mV during the nucleation stage and the internal region growth stage.

Preparation of Emulsion Em 4-4

Emulsion Em 4-4 was prepared similarly to Em 4-1, except that solution (H-42) was replaced by solution (H-43).

Preparation of Emulsion Em 4-5

Emulsion Em 4-5 was prepared similarly to Em 4-1, except that solution (H-42) was replaced by solution (H-44), as shown below:

| H-44 | |
|---|---|
| Potassium bromide | 500.0 g |
| Distilled water to make | 6.72 lit. |

Preparation of Emulsion Em 4-6

Emulsion Em 4-6 was prepared similarly to Em 4-5, except that the high iodide phase was introduced after the aqueous silver nitrate solution (S-41) was added in an amount corresponding to 82% of the total silver amount.

Preparation of Emulsion Em 4-7

Emulsion Em 4-7 was prepared similarly to Em 4-5, except that the high iodide phase was introduced after the aqueous silver nitrate solution (S-41) was added in an amount corresponding to 88% of the total silver amount.

Preparation of Emulsion Em 4-8

Emulsion Em 4-8 was prepared similarly to Em 4-5, except that the EAg was maintained at −25 mV during the growth stage of the internal region and the EAg was adjusted to −40 mV after adding solution (B-41).

Preparation of Emulsion Em 4-9

Emulsion Em 4-9 was prepared similarly to Em 4-8, except that mother liquor (Gr-41) and solution (G-41) were replaced by solutions (Gr-42) and (G-42), respectively, and the amount of aqueous ammonia solution added in the ripening stage was reduced to ⅕.

| | |
|---|---|
| Gr-42 | |
| Alkali-processed inert gelatin | 64.44 g |
| Potassium bromide | 36.04 g |
| Distilled water to make | 12.2 lit. |
| G-42 | |
| Alkali-processed inert gelatin (mean molecular weight of ca. 100,000) | 47.90 g |
| 10 wt % Methanol solution of EO-1*[1] | 3.48 ml |
| Distilled water to make | 3.18 lit. |

Grain characteristics of the thus prepared emulsions were determined in accordance with the measurement procedure described earlier and results thereof are shown in Table 6.

TABLE 6

| Emulsion No. | Iodide Content of Internal Region (mol %) | High Iodide Phase (vol. %)* | Aspect Ratio | Grain Thickness D (μm) | Average Iodide Content (mol %) | Remark |
|---|---|---|---|---|---|---|
| Em 4-1 | 3 | 70 | 8.0 | 0.149 | 4.6 | Comp. |
| Em 4-2 | 1 | 50 | 8.0 | 0.149 | 3.2 | Comp. |
| Em 4-3 | 1 | 70 | 4.0 | 0.237 | 3.2 | Comp. |
| Em 4-4 | 1 | 70 | 8.0 | 0.149 | 3.2 | Inv. |
| Em 4-5 | 0 | 70 | 8.0 | 0.149 | 2.5 | Inv. |
| Em 4-6 | 0 | 82 | 8.0 | 0.149 | 2.5 | Inv. |
| Em 4-7 | 0 | 88 | 8.0 | 0.149 | 2.5 | Inv. |
| Em 4-8 | 0 | 70 | 12.0 | 0.114 | 2.5 | Inv. |
| Em 4-9 | 0 | 70 | 26.0 | 0.068 | 2.5 | Inv. |

*Position at which the high iodide phase was introduced, which was expressed in terms of volume %.

Preparation of Silver Halide Photographic Material

Similarly to Example 1, emulsions Em 4-1 through 4-9 were each subjected to chemical sensitization, coated and dried to obtain photographic material sample Nos. 401 through 409, respectively.

Evaluation of Characteristics

Similarly to Example 1, samples were subjected to the foregoing exposure and the process-1 or process-2 and evaluated with respect to contrast (ΔG) and forced developability ($\Delta S_T$) in accordance with the procedure described in Example 1. Samples were also exposed and subjected to process-3 or process-4 and evaluated with respect to process stability in accordance with the procedure described below.

Process-3

Process-3 was conducted similarly to the foregoing Process-1, except that the amount of potassium iodide (0.1% solution) used in the first developer was varied from 2 ml to 10 ml.

Process-4

Process-4 was conducted similarly to the foregoing Process-1, except that the pH of the first developer was varied from 9.60 to 10.00.

Process Stability-1: $\Delta G_r$

Process stability-1 ($\Delta G_r$) was determined as a ratio of a ΔG value in the process-3 (denoted as $\Delta G_3$) to a ΔG value in the process-1 (denoted as $\Delta G_1$), as defined below. This is a measure indicating stability for variation in activity of the first development (iodide ion content), and the value closer to 1 indicates less variation in contrast.

$$\Delta G_r = \Delta G(process\text{-}3)/\Delta G(\text{process-1}) = \Delta G_3/\Delta G_1$$

Process Stability-2: $\Delta G_p$

Process stability-2 ($\Delta G_p$) was determined as a ratio of a ΔG value in the process-4 (denoted as $\Delta G_4$) to a ΔG value in the process-1 ($\Delta G_1$), as defined below. This is a measure indicating stability for variation in pH of the first development, and the value closer to 1 indicates less in contrast.

$$\Delta G_p(\text{process-4})/\Delta G(\text{process-1}) = \Delta G_4/\Delta G_1$$

The thus obtained evaluation results are shown in Table 7.

TABLE 7

| Sample No. | Emulsion No. | ΔG | $\Delta G_r$ | $\Delta G_p$ | $\Delta S_T$ | Remark |
|---|---|---|---|---|---|---|
| 401 | Em 4-1 | 0.50 | 0.49 | 0.51 | 1.41 | Comp. |
| 402 | Em 4-2 | 0.80 | 0.35 | 0.39 | 1.52 | Comp. |
| 403 | Em 4-3 | 0.75 | 0.35 | 0.50 | 1.50 | Comp. |
| 404 | Em 4-4 | 1.00 | 0.70 | 0.70 | 1.28 | Inv. |
| 405 | Em 4-5 | 1.30 | 0.77 | 0.83 | 1.23 | Inv. |
| 406 | Em 4-6 | 1.25 | 0.90 | 0.90 | 1.11 | Inv. |
| 407 | Em 4-7 | 1.23 | 0.95 | 0.95 | 1.03 | Inv. |
| 408 | Em 4-8 | 1.15 | 0.93 | 0.94 | 1.05 | Inv. |
| 409 | Em 4-9 | 1.30 | 0.96 | 0.97 | 1.00 | Inv. |

As apparent from Table 7, it was proved that samples Nos. 404 through 409 using the inventive emulsions Em 4-4 through Em 4-9 exhibited superior contrast, process stability and sensitization suitability, compared to samples Nos. 401 through 403. It was noted that improvement effects were marked in samples Nos. 405 through 409 using emulsions Em 4-5 through Em 4-9, in which no iodide was contained in the internal region. It was further noted that the use of emulsion Em 4-6 (sample No. 406), in which the location of the high iodide phase was external to 80% by volume of the grain, was markedly effective and the use of emulsion Em 4-7 (sample No. 407), in which the location of the high iodide phase was external to 85% by volume of the grain, was further markedly effective. It was also confirmed that the use of emulsion Em 4-8 (sample No. 408), having an aspect ratio of more than 10 was markedly effective and the use of emulsion Em 4-8 (sample No. 408), having a thickness of less than 0.07 μm was further markedly effective.

Example 5

Preparation of Silver Halide Emulsion Em 5-1

Emulsion Em 5-1 was prepared similarly to emulsion Em 4-5 of Example 4, except that the temperature within the reaction vessel was lowered to 40° C. after completion of the internal region growth stage and before starting the high iodide phase formation and the EAg was controlled to be maintained at −39 mV during the shell growth stage.

Grain characteristics of the thus prepared emulsion Em 5-1 and emulsion Em 4-5 of Example 4 were determined in accordance with the measurement procedure described earlier and results thereof are shown in Table 8.

TABLE 8

| Emulsion No. | Dislocation Line*1 (% by number) | Iodide Content of Internal Region (mol %) | High Iodide Phase (vol. %)*2 | Aspect Ratio | Thickness D (μm) | Average Iodide Content (mol %) |
|---|---|---|---|---|---|---|
| Em 5-1 | 50.0 | 0 | 70 | 8.0 | 0.149 | 2.5 |
| Em 4-5 | 0 | 0 | 70 | 8.0 | 0.149 | 2.5 |

*1The number of grains having at least 30 dislocation lines
*2Position at which the high iodide phase was introduced, which was expressed in terms of volume %.

Preparation of Silver Halide Photographic Material

Emulsion Em 5-1 was subjected to chemical sensitization similarly to Example 1 and using this emulsions, photographic material sample No. 501 was prepared similarly to Example 1.

Evaluation of Characteristics

Similarly to Example 4, the thus prepared samples No. 501 and sample No. 405 of Examples 4 were each exposed and subjected to process-1 through process-4, and evaluated with respect to contrast, process stability and forced developability. Obtained results are shown in Table 9, in which contrast (ΔG) and sensitization suitability ($\Delta S_T$) were each represented by a relative value, based on those of sample No. 405 being respectively 1.00.

TABLE 9

| Sample No. | Emulsion No. | ΔG | $\Delta G_r$ | $\Delta G_p$ | $\Delta S_T$ |
|---|---|---|---|---|---|
| 501 | Em 5-1 | 1.22 | 0.85 | 0.88 | 1.23 |
| 405 | Em 4-5 | 1.00 | 0.77 | 0.83 | 1.00 |

As apparent from Table 9, it was proved that the use of emulsion Em 5-1 comprised of silver halide grains having at least 30 dislocation lines (Sample 501) resulted in improvements in contrast, process stability and sensitization suitability, compared to sample No. 405

Example 6

Preparation of Silver Halide Emulsion Em 6-1

Emulsion Em 6-1 was prepared similarly to emulsion Em 5-1 of Example 5, except that an ultrafiltration apparatus was employed during the internal region growth stage to maintain the reaction solution volume within the reaction vessel at the same level as the volume at the completion of the nuclear ripening, and after completion of the internal region growth stage, the temperature within the reaction vessel was lowered to 40° C., the reaction solution was concentrated to 14.8 lit. and the volume of the reaction solution was maintained until completion of the subsequent growth stage.

Preparation of Emulsion Em 6-2

Emulsion Em 4-2 was prepared similarly to emulsion Em 6-1, except that the reaction solution was concentrated to 6.67 lit., simultaneously with completion of lowering the temperature within the reaction vessel to 40° C.

Preparation of Emulsion Em 6-3

Emulsion Em 6-3 was prepared similarly to emulsion Em 6-1, except that the reaction solution was concentrated to 13.3 lit. simultaneously with completion of lowering the temperature within the reaction vessel to 40° C., and solutions A-41 and B-41 were replaced by the following solutions A-62 and B-62, respectively:

| | |
|---|---|
| A-62 | |
| Sodium p-iodoacetoamidobenzenesulfonate | 123.1 g |
| $H_2O$ | 1231.1 ml |
| B-62 | |
| Sodium sulfite | 42.7 g |
| $H_2O$ | 657.4 ml |

Preparation of Emulsion Em 6-4

Emulsion Em 6-4 was prepared similarly to emulsion Em 6-1, except that the reaction solution was concentrated to 13.3 lit., simultaneously with lowering the temperature within the reaction vessel to 40° C., solutions Gr-41 and G-41 were replaced by the following solutions Gr-63 and G-63, respectively, and flow rates of solutions S-1 and H-1 were each varied to 0.60 times in the nucleation stage.

| | |
|---|---|
| Gr-63 | |
| Alkali-processed inert gelatin (mean molecular weight of 100,000) | 18.50 g |
| Potassium bromide | 5.64 g |
| Distilled water to make | 7.40 lit. |
| G-63 | |
| Alkali-processed inert gelatin (mean molecular weight of 100,000) | 79.28 g |
| EO-1 (10 wt % methanol solution) | 2.67 ml |
| Distilled water to make | 1.93 lit. |

Grain characteristics of the thus prepared emulsions Em 6-1 through 6-4 and emulsion Em 5-1 of Example 5 were determined in accordance with the measurement procedure described earlier and results thereof are shown in Table 10.

TABLE 10

| Emulsion No. | Dislocation Line*1 (% by number) | Reaction Solution Volume*2 (l/mol Ag) | Iodide Content of Internal Region (mol %) | High Iodide Phase (vol. %)* | Aspect Ratio | Thickness D (μm) | Average Iodide Content (mol %) | ECEL*3 (μm) |
|---|---|---|---|---|---|---|---|---|
| Em 6-1 | 70.0 | 2.0 | 0 | 70 | 8.0 | 0.149 | 2.5 | 0.55 |
| Em 6-2 | 95.0 | 0.9 | 0 | 70 | 8.0 | 0.149 | 2.5 | 0.55 |
| Em 6-3 | 80.0 | 1.8 | 0 | 70 | 8.0 | 0.149 | 2.5 | 0.55 |

TABLE 10-continued

| Emulsion No. | Dislocation Line*1 (% by number) | Reaction Solution Volume*2 (l/mol Ag) | Iodide Content of Internal Region (mol %) | High Iodide Phase (vol. %)* | Aspect Ratio | Thickness D (μm) | Average Iodide Content (mol %) | ECEL*3 (μm) |
|---|---|---|---|---|---|---|---|---|
| Em 6-4 | 87.0 | 1.8 | 0 | 70 | 8.0 | 0.176 | 2.5 | 0.65 |
| Em 5-1 | 50.0 | 3.7 | 0 | 70 | 8.0 | 0.149 | 2.5 | 0.55 |

*1The number of grains having at least 30 dislocation lines
*2The volume of a reaction solution immediately before formation of the high iodide phase
*3Average equivalent cube edge length Preparation of Silver Halide Photographic Material Emulsions Em 6-1 through 6-4 were subjected to chemical sensitization similarly to Example 1 and using these emulsions, photographic material sample Nos. 601 through 604 similarly to Example 4.

Evaluation of Characteristics

Similarly to Example 4, the thus prepared samples Nos. 601 through 604 and sample No. 501 of Examples 5 were each exposed and subjected to process-1 through process-4, and evaluated with respect to contrast, process stability and forced developability. Obtained results are shown in Table 11, in which contrast (ΔG) and forced developability ($\Delta S_T$) were each represented by a relative value, based on those of sample No. 501 being respectively 1.00.

TABLE 11

| Sample No. | Emulsion No. | ΔG | $\Delta G_r$ | $\Delta G_p$ | $\Delta S_T$ |
|---|---|---|---|---|---|
| 601 | Em 6-1 | 1.22 | 0.91 | 0.92 | 1.22 |
| 602 | Em 6-2 | 1.42 | 0.99 | 0.98 | 1.42 |
| 603 | Em 6-3 | 1.33 | 0.94 | 0.96 | 1.40 |
| 604 | Em 6-4 | 1.29 | 0.92 | 0.93 | 1.35 |
| 501 | Em 5-1 | 1.00 | 0.85 | 0.88 | 1.00 |

As apparent from Table 11, it was proved that in emulsions Em 6-1 through 6-4, in which the reaction solution within the reaction vessel was concentrated to so as to a volume of not more than 2.5 lit. per mol of silver halide, dislocation lines were introduced a relatively high density, compared to emulsion Em 5-1, which was not concentrated. It was further proved that the use of emulsions Em 6-1 through Em 6-4, comprised of silver halide grains having at least 30 dislocation lines (sample Nos. 601 through 604) resulted in improved contrast, process stability and sensitization suitability, compared to sample No. 501.

Example 7

Preparation of Silver Halide Emulsion

Preparation of Em 7-1

Emulsion Em 7-1 was prepared similarly to emulsion Em 6-1 of Example 6, except that the EAg was controlled to be maintained at +12 mV during the internal region growth stage and the EAG was controlled to be maintained at −45 mV during the shell growth stage.

Preparation of Emulsion Em 7-2

Emulsion Em 9-2 was prepared similarly to emulsion Em 6-1 of Example 6, except that the EAg was controlled to be maintained at +18 mV during the internal region growth stage and the EAG was controlled and maintained at −51 mV during the shell growth stage.

Preparation of Emulsion Em 7-3

Emulsion Em 9-3 was prepared similarly to emulsion Em 6-1 of Example 6, except that EAg was controlled to be maintained at −15 mV during the internal region growth stage and the EAG was controlled to be maintained at −48 mV during the shell growth stage.

Grain characteristics of the thus prepared emulsions Em 7-1 through 7-3 of Example 6 were determined in accordance with the measurement procedure described earlier and results thereof are shown in Table 12.

TABLE 12

| Emulsion No. | r/d | d (μm) | (r/d)/(R/D) | d/D | Iodide Content of Internal region (mol %) | High Iodide Phase (vol. %)* | Aspect Ratio | Thickness D (μm) | Average Iodide Content (mol %) | ECEL*2 (μm) |
|---|---|---|---|---|---|---|---|---|---|---|
| Em 7-1 | 8.5 | 0.127 | 1.06 | 0.85 | 0 | 70 | 8.0 | 0.149 | 2.5 | 0.55 |
| Em 7-2 | 7.5 | 0.138 | 0.94 | 0.93 | 0 | 70 | 8.0 | 0.149 | 2.5 | 0.55 |
| Em 7-3 | 8.9 | 0.136 | 1.11 | 0.91 | 0 | 93 | 8.0 | 0.149 | 2.5 | 0.55 |
| Em 6-1 | 9.5 | 0.118 | 1.19 | 0.79 | 0 | 70 | 8.0 | 0.149 | 2.5 | 0.55 |

*1Position at which the high iodide phase is introduced.
*2Average equivalent cube edge length Preparation of Silver Halide Photographic Material Emulsions Em 7-1 through 7-3 were subjected to chemical sensitization similarly to Example 1 and using these emulsions, photographic material sample Nos. 701 through 703 were prepared similarly to Example 4.

Evaluation of Characteristics

Similarly to Example 1, the thus prepared samples Nos. 701 through 703 and sample No. 601 of Examples 6 were each exposed and subjected to process-1 through process-4, and evaluated with respect to contrast, process stability and forced developability. Obtained results are shown in Table 8, in which contrast (ΔG) and forced developability ($\Delta S_T$) were each represented by a relative value, based on those of samples No. 601 being respectively 1.00.

TABLE 13

| Sample No. | Emulsion No. | ΔG | $\Delta G_r$ | $\Delta G_p$ | $\Delta S_T$ |
|---|---|---|---|---|---|
| 701 | Em 7-1 | 1.22 | 0.95 | 0.95 | 1.38 |
| 702 | Em 7-2 | 1.32 | 0.98 | 0.99 | 1.50 |
| 703 | Em 7-3 | 1.24 | 0.93 | 0.94 | 1.35 |
| 601 | Em 6-1 | 1.00 | 0.91 | 0.92 | 1.00 |

As apparent from Table 13, it was proved that samples No. 701 and 702 using emulsions Em 7-1 and 7-2 comprised of grains, in which the ratio of an aspect ratio of the internal region (r/d) to an aspect ratio of the grain (R/D) was not more than 1.10 exhibited further improved results in contrast, process stability and forced developability, compared to sample No. 601 using emulsion Em 6-1 comprised of grains, in which the ratio of (r/d) to (R/D) was more than 1.10. It was further proved that samples No. 702 and 703 using emulsions Em 7-2 and 7-3 comprised of grains, in which the ratio of d to D (d/D) was not less than 0.90 exhibited further improved results in contrast, process stability and forced developability, compared to sample No. 601 using emulsion Em 6-1 comprised of grains, in which the ratio of (d/D) was less than 0.90.

Example 8

Preparation of Silver Halide Emulsion Em 8-1

Emulsion Em 8-1 was prepared similarly to emulsion Em 5-1 of Example 5, except that the temperature within the reaction vessel was lowered to 30° C. after completion of the internal region growth stage and before starting the high iodide phase formation.

Preparation of emulsion Em 8-2

Emulsion Em 8-2 was prepared similarly to emulsion Em 8-1, except that a sodium hydroxide aqueous solution was added at a constant flow rate in 5 min. to introduce a high iodide phase so that the rate of releasing iodide ions was relatively equalized.

Grain characteristics of the thus prepared emulsions Em 8-1 and 8-2, and emulsion Em 5-1 of Example 5 were determined in accordance with the measurement procedure described earlier and results thereof are shown in Table 14. In the Table, $I_d$ and $I_r$ represent an average iodide content ($I_d$) of the side face side of the high iodide phase and an average iodide content ($I_r$) of the major face side of the high iodide phase.

TABLE 14

| Emulsion No. | $I_d/I_r$ | Iodide Content of Internal Region (mol %) | High Iodide Phase (vol. %)* | Aspect Ratio | Thickness D (μm) | Average Iodide Content (mol %) |
|---|---|---|---|---|---|---|
| Em 8-1 | 1.52 | 0 | 70 | 8.0 | 0.149 | 2.5 |
| Em 8-2 | 2.02 | 0 | 70 | 8.0 | 0.149 | 2.5 |
| Em 5-1 | 1.00 | 0 | 70 | 8.0 | 0.149 | 2.5 |

*Position at which the high iodide phase is introduced.

Preparation of Silver Halide Photographic Material

Emulsions Em 8-1 and 8-2 were subjected to chemical sensitization similarly to Example 1 and using these emulsions photographic material sample Nos. 801 and 802 were prepared similarly to Example 4.

Evaluation of Characteristics

Similarly to Example 4, the thus prepared samples Nos. 801 and 802 and sample No. 501 of Examples 5 were each exposed and subjected to process-1 through process-4, and evaluated with respect to contrast, process stability and forced developability. Obtained results are shown in Table 15, in which contrast (ΔG) and forced developability ($\Delta S_T$) were each represented by a relative value, based on those of sample No. 501 being respectively 1.00.

TABLE 15

| Sample No. | Emulsion No. | ΔG | $\Delta G_r$ | $\Delta G_p$ | $\Delta S_T$ |
|---|---|---|---|---|---|
| 801 | Em 8-1 | 1.22 | 0.93 | 0.93 | 1.23 |
| 802 | Em 8-2 | 1.42 | 0.95 | 0.96 | 1.38 |
| 501 | Em 5-1 | 1.00 | 0.85 | 0.88 | 1.00 |

As apparent from Table 15, it was proved that samples No. 801 and 802 using emulsions Em 8-1 and 8-2 comprised of grains, in which the average iodide content ($I_d$) of the side face side of the high iodide phase was more than the average iodide content ($I_r$) of the major face side of the high iodide phase resulted in further enhanced improvements in contrast, process stability and forced developability.

Example 9

Preparation of Silver Halide Emulsion

Emulsions Em 9-1 through 9-4 were prepared in the following manner, in which a hole trap zone was formed in the interior of the grain.

Preparation of Emulsion Em 9-1

Emulsion Em 11-1 was prepared similarly to emulsion Em 4-1 of Example 4, except that the pH was adjusted to 8.0 at the finish of the nuclear ripening stage using a sulfuric acid aqueous solution and in the subsequent internal region growth stage, the pH was adjusted to 5.0 at the time 20% of total silver was consumed, using an acetic acid aqueous solution, then, the growth further continued.

Preparation of Emulsion Em 9-2

Emulsion Em 9-2 was prepared similarly to emulsion Em 9-1, except that solution (H-42) was replaced by solution (H-3) used in the preparation of emulsion Em 4-1 of Example 4 and a high iodide phase was introduced at the time 50% of total silver was consumed.

Preparation of emulsion Em 9-3

Emulsion Em 9-3 was prepared similarly to emulsion Em 9-1, except that solution (H-42) was replaced by solution (H-43) used in Example 1 and the EAg was controlled to be maintained at +20 mV during the ripening and internal region growth stage.

Preparation of emulsion Em 9-4

Emulsion Em 9-4 was prepared similarly to emulsion Em 9-1, except that solution (H-42) was replaced by solution (H-44) used in the preparation of emulsion Em 4-5 of Example 4.

Grain characteristics of the thus prepared emulsions Em 9-1 through 9-4, which included a hole trap zone and emulsions Em 4-1, 4–3 and 4-5, which included no hole trap zone were determined in accordance with the measurement procedure described earlier and results thereof are shown in Table 16.

TABLE 16

| Emulsion No. | Hole Trap Zone | Iodide Content of Internal Region (mol %) | High Iodide Phase (vol. %)* | Aspect Ratio | Thickness D (μm) | Average Iodide Content (mol %) | |
|---|---|---|---|---|---|---|---|
| Em 9-1 | Yes | 3 | 70 | 8.0 | 0.149 | 4.6 | Comp. |
| Em 9-2 | Yes | 1 | 50 | 8.0 | 0.149 | 3.0 | Comp. |
| Em 9-3 | Yes | 1 | 70 | 4.0 | 0.237 | 3.2 | Comp. |
| Em 9-4 | Yes | 0 | 70 | 8.0 | 0.149 | 2.5 | Inv. |
| Em 4-1 | No | 3 | 70 | 8.0 | 0.149 | 4.6 | Comp. |
| Em 4-2 | No | 1 | 50 | 8.0 | 0.149 | 3.0 | Comp. |
| Em 4-3 | No | 1 | 70 | 4.0 | 0.237 | 3.2 | Comp. |
| Em 4-5 | No | 0 | 70 | 8.0 | 0.149 | 2.5 | Inv. |

*Position at which the high iodide phase is introduced.

Preparation of Silver Halide Photographic Material

Emulsions Em 9-1 through 9-4 were subjected to chemical sensitization similarly to Example 1 and using these emulsions, photographic material sample Nos. 901 through 904 were prepared similarly to Example 4.

Evaluation of Characteristics

Similarly to Example 4, the thus prepared samples Nos. 901 through 904 and samples Nos. 401, 402, 403 and 405 of Examples 4 were each exposed and subjected to process-1 through process-4, and evaluated with respect to contrast, process stability and forced developability. Obtained results are shown in Table 17, in which contrast (ΔG) and forced developability ($\Delta S_T$) were each represented by a relative value, i.e., in the case of samples Nos. 901 through 904, based on those of sample No. 903 being respectively 1.00, and in the case of samples Nos. 401, 402, 403 and 405, those of sample No. 403 being respectively 1.00.

TABLE 17

| Sample No. | Emulsion No. | ΔG | $\Delta G_r$ | $\Delta G_p$ | $\Delta S_T$ | |
|---|---|---|---|---|---|---|
| 901 | Em 9-1 | 0.71 | 0.42 | 0.43 | 1.00 | Comp. |
| 902 | Em 9-2 | 1.00 | 0.36 | 0.38 | 1.00 | Comp. |
| 903 | Em 9-3 | 1.00 | 0.42 | 0.52 | 1.00 | Comp. |
| 904 | Em 9-4 | 1.56 | 0.89 | 0.91 | 2.00 | Inv. |
| 401 | Em 4-1 | 0.67 | 0.49 | 0.51 | 1.00 | Comp. |
| 402 | Em 4-2 | 1.00 | 0.35 | 0.39 | 0.94 | Comp. |
| 403 | Em 4-3 | 1.00 | 0.35 | 0.50 | 1.00 | Comp. |
| 405 | Em 4-5 | 1.33 | 0.77 | 0.83 | 1.82 | Inv. |

As apparent from Table 17, it was proved that Sample No. 901 resulted in improvements in contrast, process and forced developability, compared to sample Nos. 901, 902 and 903. Specifically, inclusion of the hole trap led to further enhanced improvement effects, compared to sample No. 105, which was compared to samples Nos. 101, 102 and 103.

Example 10

Preparation of Silver Halide Color Photographic Material

On a triacetyl cellulose film support were formed the following layers containing composition as shown below to prepare a multi-layered color photographic material sample 1001. The addition amount of each compound was represented in term of g/m$^2$, provided that the amount of silver halide or colloidal silver was converted to the silver (g/m$^2$).

| | |
|---|---|
| 1st Layer (Anti-Halation Layer) | |
| Black colloidal silver | 0.24 |
| UV absorbent (UV-1) | 0.20 |
| High boiling solvent (OIL-2) | 0.20 |
| Gelatin | 1.50 |
| 2nd Layer (Intermediate Layer) | |
| Compound (SC-1) | 0.14 |
| High boiling solvent (OIL-2) | 0.17 |
| Gelatin | 0.70 |
| 3rd Layer (Low-speed Red-Sensitive Layer) | |
| Emulsion | 0.48 |
| Coupler (C-1) | 0.25 |
| High boiling solvent (OIL-2) | 0.10 |
| Gelatin | 0.65 |
| 4th Layer (Intermediate-speed Red-sensitive Layer) | |
| Emulsion | 0.46 |
| Coupler (C-1) | 0.35 |
| High boiling solvent (OIL-1) | 0.12 |
| Gelatin | 0.72 |
| 5th Layer (High-speed Red-Sensitive Layer) | |
| Emulsion | 0.55 |
| Coupler (C-1) | 0.70 |
| High boiling solvent (OIL-1) | 0.40 |
| Gelatin | 1.00 |
| 6th Layer (Intermediate Layer) | |
| Compound (SC-1) | 0.25 |
| High boiling solvent (OIL-2) | 0.30 |
| Gelatin | 1.20 |
| 7th Layer (Low-speed Green-Sensitive Layer) | |
| Emulsion | 0.48 |
| Magenta coupler (MM-1) | 0.15 |
| Magenta coupler (MM-2) | 0.04 |
| High boiling solvent (IL-2) | 0.04 |
| Gelatin | 0.60 |
| 8th Layer (Intermediate-speed Green-Sensitive Layer) | |
| Emulsion | 0.45 |
| Magenta coupler (MM-1) | 0.20 |
| Magenta coupler (MM-2) | 0.05 |
| High boiling solvent (IL-2) | 0.07 |
| Gelatin | 0.70 |
| 9th Layer (High-speed Green-Sensitive Layer) | |
| Emulsion | 0.61 |
| Magenta coupler (MM-1) | 0.36 |
| Magenta coupler (MM-2) | 0.07 |
| High boiling solvent (IL-2) | 0.20 |
| Gelatin | 1.00 |
| 10th Layer (Interlayer) | |
| Compound (SC-1) | 0.20 |
| High boiling solvent (OIL-2) | 0.24 |
| Gelatin | 0.80 |
| 11th Layer (Yellow Filter Layer) | |
| Yellow colloidal silver | 0.15 |
| Compound (SC-1) | 0.15 |
| High boiling solvent (OIL-2) | 0.17 |
| Gelatin | 0.90 |
| 12th Layer (Low-speed Blue-sensitive Layer) | |
| Emulsion | 0.20 |
| Coupler (Y-1) | 0.45 |
| High boiling solvent (OIL-2) | 0.05 |
| Gelatin | 0.65 |
| 13th Layer (Intermediate-sped Blue-sensitive Layer) | |
| Emulsion | 0.18 |
| Coupler (Y-1) | 0.45 |
| High boiling solvent (OIL-2) | 0.05 |
| Gelatin | 0.65 |

-continued

| | |
|---|---|
| 14th Layer (High-sped Blue-sensitive Layer) | |
| Emulsion | 0.72 |
| Coupler (Y-1) | 0.92 |
| High boiling solvent (OIL-2) | 0.10 |
| Gelatin | 1.25 |
| 15th Layer (First Protective Layer) | |
| Compound (SC-1) | 0.12 |
| High boiling solvent (OIL-2) | 0.15 |
| Gelatin | 0.60 |
| 16th Layer: Second protective Layer | |
| Light-insensitive silver halide emulsion having a mean grain size of 0.08 μm, containing 1 mol 5 iodide | 0.30 |
| UV absorvent (UV-1) | 0.25 |
| UV absorvent (UV-2) | 0.06 |
| High boiling solvent (OIL-2) | 0.20 |
| Gelatin | 1.40 |
| 17th Layer (Third Protective Layer) | |
| Polymer PM-1 | 0.12 |
| Polymer PM-2 | 0.03 |
| Lubricant (WAX-1) | 0.03 |
| Gelatin | 0.55 |

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

SU-1: $C_8F_{17}SO_2N(C_3H_7)CH_2COOK$

SU-2: $C_8F_{17}SO_2NH(CH_2)_3N^+(CH_3)_3Br^-$

Su-3: Sodium di-(2-ethylhexyl) sulfosuccinate

SU-4: Tri-i-propylnaphthalenesulfonic acid sodium salt

ST-1: 4-hydroxy-6-methyl-1,3,3a,7-tetraazaindene

ST-2: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $[CH_2{=}CHSO_2CH_2)_3CCH_2SO_2CH_2CH_2]_2NCH_2CH_2SO_3K$

H-2: 2,4-Dichloro-6-hydroxy-s-triazine sodium salt

OIL-1: Tricresyl phosphate

OIL-2: Di(2-ethylhexyl)phthalate

Coupler C-1

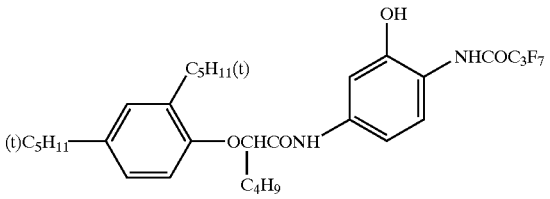

-continued

Coupler MM-1

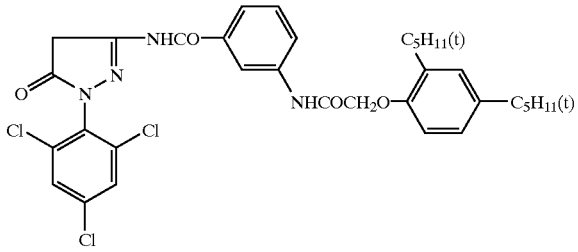

Coupler MM-2

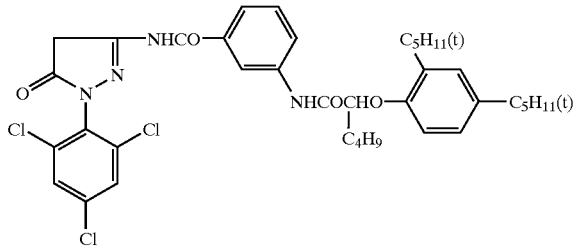

Coupler Y-1

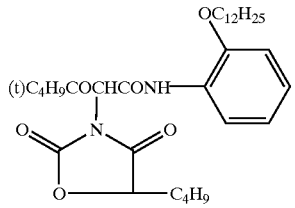

Compound SC-1

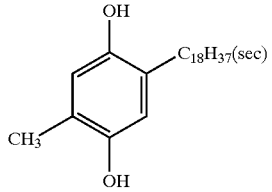

WAX-1

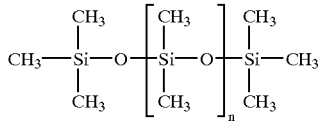

Mw = 3,000

PM-1

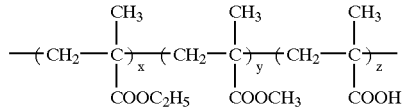

x:y:z = 3:3:4

PM-2

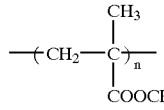

n: Degree of polymerization

UV-1

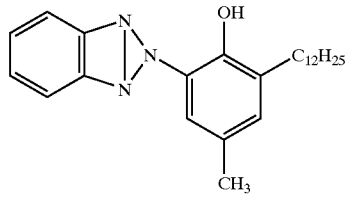

-continued
UV-2
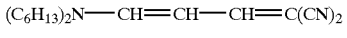
V-1
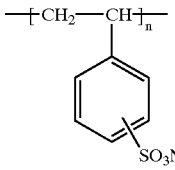
n: Degree of polymerization
Ase-1
(Three component mixture as below)
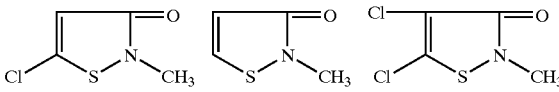
A:B:C = 50:46:4 (Molar ratio)
S-1
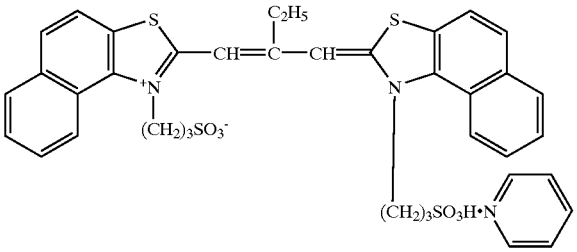
S-2
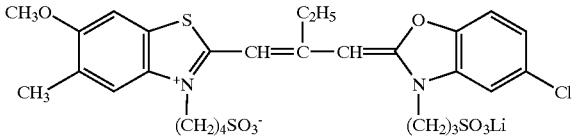
S-3
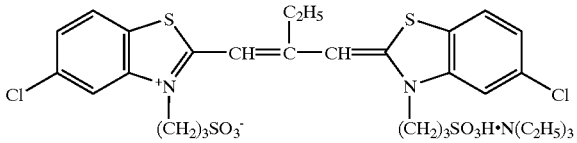
S-4
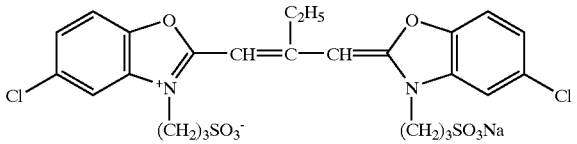
S-5
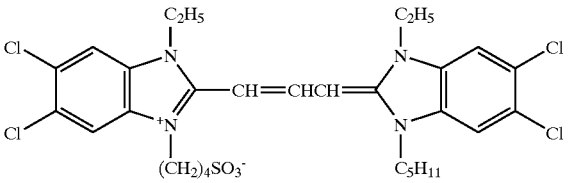
S-6
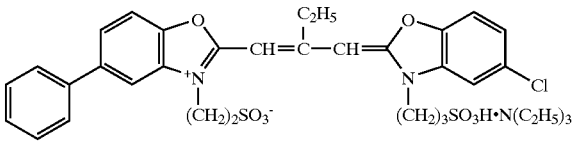
-continued
S-7
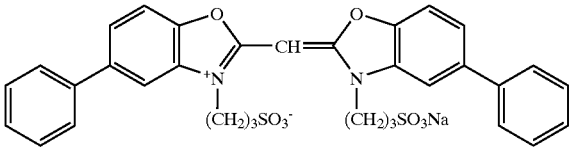
S-8
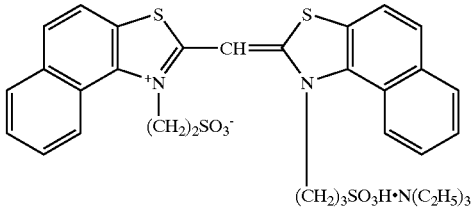
S-9
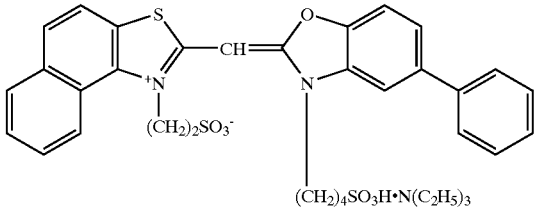
FF-1
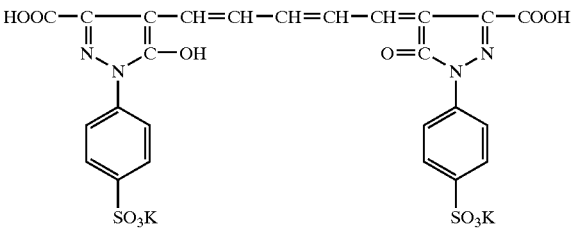
FF-2
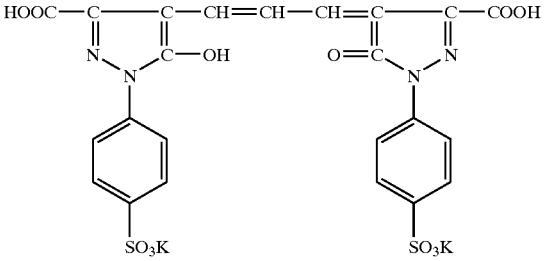
MF-1 Mixture (A:B = 4:6)
A
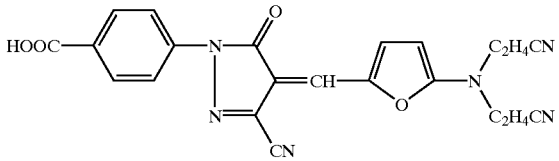
B
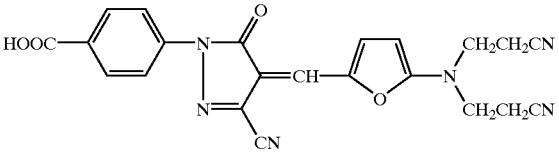
Light-sensitive silver halide emulsions used in Sample 1001 are summarized in Table 1. Emulsion were each chemically sensitized together with sensitizing dyes (Dye s-1 to S-8), as shown in Table 18.

TABLE 18

| Layer | Emulsion | Grain Feature | Silver Coverage (g/m$^2$) | Grain Size (μm) | Iodide (mol %) | Dye |
|---|---|---|---|---|---|---|
| Low-speed Red-sensitive Layer | A1 | Cub. | 0.24 | 0.36 | 3.2 | S-1, S-2, S-3 |
| | B1 | Cub. | 0.24 | 0.27 | 4.0 | S-1, S-2, S-3 |
| Intermediate-speed Red-sensitive Layer | C1 | Cub. | 0.46 | 0.45 | 3.2 | S-1, S-2, S-3 |
| High-speed Red-sensitive Layer | D1 | Tabular | 0.50 | 0.50 | 2.5 | S-1, S-2, S-3 |
| | E1 | Cub. | 0.05 | 0.27 | 4.0 | S-1, S-2, S-3 |
| Low-speed Green-sensitive Layer | F1 | Tetr. | 0.24 | 0.36 | 3.2 | S-4, S-5, S-6 |
| | G1 | Tetr. | 0.24 | 0.24 | 3.0 | S-4, S-5, S-6 |
| Intermediate-speed Green-sensitive Layer | Em 3-7 | Tabular | 0.45 | 0.36 | 3.2 | S-4, S-5, S-6 |
| High-speed Green-sensitive Layer | Em 1-1 | Tabular | 0.55 | 0.50 | 2.5 | S-4, S-5, S-6 |
| | J1 | Cub. | 0.06 | 0.24 | 3.0 | S-4, S-5, S-6 |
| Low-speed Blue-sensitive Layer | K1 | Cub. | 0.10 | 0.36 | 3.2 | S-7, S-8 |
| | L1 | Cub. | 0.10 | 0.27 | 4.0 | S-7, S-8 |
| Intermediate-speed Blue-sensitive Layer | M1 | Cub. | 0.18 | 0.70 | 2.0 | S-7, S-8 |
| High-speed Blue-sensitive Layer | N1 | Tabular | 0.52 | 1.20 | 1.6 | S-7, S-8 |
| | O1 | Cub. | 0.20 | 0.70 | 2.0 | S-7, S-8 |

Cub.: Cubic grain
Tabular: Tabular grain

In the Table, the grain size is represented by a equivalent cube edge length. Photographic material samples Nos. 1002 through 1008 were prepared similarly to sample No. 1001, except that emulsion Em 1-1 used in the 9th layer was replaced by an emulsion as shown in Table 19. Sample 1009 was prepared similarly to sample No. 1002, except that emulsion Em 3-7 used in the 8th layer was replaced by Em 3-2.

Evaluation

The thus prepared samples were each exposed to white light through an optical wedge for 1/100 sec using a light source of 5400K and subjected to the following process-5 or process-6.

Process-5

Process-5 was conducted similarly to the foregoing Process-1, except that the amount of potassium iodide used in the first developer was varied to 0.5 g and the first developing time was varied from 4 min. to 6 min.

Process-6

Process-6 was conducted similarly to the foregoing Process-1, except that the amount of potassium iodide used in the first developer was varied to 0.5 g and the first developing time was varied from 4 min. to 9 min.

The processed samples were evaluated with respect to sensitivity, contrast and forced developability in the manner described below.

Densitometry

Processed samples were each subjected to densitometry using densitometer Status A (available from X-Rite Co.) to prepare a characteristic curve comprised of an ordinate of magenta density and an abscissa of exposure (LogE).

Sensitivity ($S_5$)

Sensitivity (S) was defined as the reciprocal of exposure giving a magenta density of 0.5 on the characteristic curve described above and the sensitivity obtained in the process-5 was represented in terms of $S_5$. The sensitivity ($S_5$) was also represented by a relative value, based on the sensitivity of sample No. 1001 being 1.00.

Contrast (ΔG')

On the characteristic curve obtained in process-5, a value of a cyan density at an exposure of 1/10 of exposure giving a magenta density of 0.5 minus 0.5 was defined as contrast (denoted as ΔG'). The thus obtained ΔG' values were represented by a relative value, based on the contrast ΔG' of sample No. 1001 being 1.00. The larger G is the higher contrast, indicating a silver halide emulsion having a high contrast characteristic.

Forced Developability ($\Delta S_T'$)

On the characteristic curve, contrasts were obtained in the process-3 and process-4, which were denoted as $AG'_3$ and $\Delta G'_4$, respectively, and forced developability ($\Delta S_T'$) was represented as a ratio of $\Delta G'_4$ to $\Delta G'_3$, as defined below:

$$\Delta S_T' = \Delta G'_4(\text{process-4})/\Delta G'_3(\text{process-3}).$$

This is a measure indicating contrast variation for variation in first development time, and the value closer to 1 indicates higher forced developability. This forced developability was represented a relative value, based on the $\Delta S_T'$ of sample No. 1009 being 1.00.

The thus obtained evaluation results are shown in Table 19.

TABLE 19

| Sample No. | 9th Layer | 8th Layer | $\Delta S_5$ | ΔG' | $\Delta S_T'$ | Remark |
|---|---|---|---|---|---|---|
| 1001 | Em 1-1 | Em 3-7 | 1.00 | 1.00 | 1.12 | Inv. |
| 1002 | Em 1-2 | Em 3-7 | 1.10 | 1.25 | 1.07 | Inv. |
| 1003 | Em 1-3 | Em 3-7 | 1.10 | 1.35 | 1.04 | Inv. |
| 1004 | Em 1-4 | Em 3-7 | 1.10 | 1.45 | 1.02 | Inv. |
| 1005 | Em 1-5 | Em 3-7 | 1.10 | 1.45 | 1.02 | Inv. |
| 1006 | Em 1-6 | Em 3-7 | 1.00 | 1.10 | 1.10 | Inv. |
| 1007 | Em 1-7 | Em 3-7 | 0.68 | 0.57 | 1.50 | Comp. |
| 1008 | Em 1-8 | Em 3-7 | 0.95 | 0.90 | 1.15 | Inv. |
| 1009 | Em 1-2 | Em 3-2 | 1.25 | 1.60 | 1.00 | Inv. |

As apparent from Table 19, photographic material samples using emulsions according to the invention led to superior results in sensitivity, contrast and forced developability.

Example 11

Photographic material sample No. 1101 was prepared similarly to sample No. 1009, except that magenta couplers MM-1 and MM-2 used in the 7th, 8th and 9th layers were replaced by a half equimolar amount of the following magenta coupler MM-3.

M-3

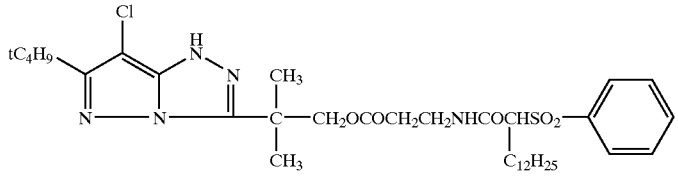

Similarly to Example 10, the thus prepared sample No. 1101, together with samples Nos. 1001 and 1009 of Example 10 were evaluated with respect to sensitivity, contrast and forced developability. The sensitivity and contrast were represented by a relative values, based on those of sample No. 1001 being 1.00. Samples were also evaluated with respect to color reproduction according to the procedure described below.

Color Reproduction

A Macbeth chart was photographed under a light source of 4800K and processed according to process-1. Color checker on color reversal film was measured using a color photometer (CR-200, available from MINOLTA CO., LTD.) to determine chroma ofblue, green, red, yellow, magenta and cyan patches for each sample. The total of chroma of these six colors was represented by a relative value, based on that of Sample No. 1001 being 1.00.

Results are shown in Table 20

TABLE 20

| Sample No. | $S_3$ | ΔG' | $\Delta S_T'$ | Chroma |
|---|---|---|---|---|
| 1001 | 1.00 | 1.00 | 1.10 | 1.00 |
| 1009 | 1.25 | 1.60 | 1.00 | 1.15 |
| 1101 | 1.25 | 1.60 | 1.00 | 1.15 |

As apparent from table 20, samples using emulsion according to the invention led to superior results in color reproduction as well as sensitivity, contrast and forced developability.

What is claimed is:

1. A silver halide emulsion comprising silver halide grains wherein the silver halide grains meet the following requirement:

(a) at least 50% of total grain projected area is accounted for by tabular grains having an aspect ratio of not less than 5

(b) a coefficient of variation of total grain size distribution is not more than 25%;

(c) an average iodide content of total grains is not more than 4 mol; and (d) the tabular grains each have major faces and contain dislocation lines in the peripheral region of the major face, and the tabular grains comprising a high iodide phase which is internal to and along the dislocation lines and an internal region surrounded by the high iodide phase, the internal region being comprised of substantially homogeneous silver halide phase and having an average iodide content of not more than 1 mol % and wherein the silver halide grains further satisfy the following equation (2):

$$I_t \leqq 1.8/x \qquad \text{equation (2)}$$

wherein $I_t$ represents the average iodide content of the grains and x represents an average equivalent cube edge length (μm).

2. The silver halide emulsion of claim 1, wherein the coefficient of variation of total grain size distribution is not more than 20%.

3. The silver halide emulsion of claim 1, wherein the coefficient of variation of total grain size distribution is not more than 10%.

4. The silver halide emulsion of claim 1, wherein the internal region contains substantially no iodide.

5. The silver halide emulsion of claim 1, wherein the silver halide grains have an average equivalent cube edge length of not more than 0.60 μm.

6. The silver halide emulsion of claim 1, wherein the silver halide grains have an average equivalent cube edge length of not more than 0.45 μm.

7. The silver halide emulsion of claim 1, wherein the silver halide grains have an average equivalent cube edge length of 0.22 to 0.40 μm.

8. The silver halide emulsion of claim 1, wherein the tabular grains satisfy the following equation (1):

$$A \geqq 16(x)^{1/2} \qquad \text{equation (1)}$$

wherein A represent an aspect ratio and x represents an average equivalent cube edge length (μm).

9. The silver halide emulsion of claim 1, wherein a coefficient of variation of total grain thickness distribution is not more than 40%.

10. The silver halide emulsion of claim 1, wherein a coefficient of variation of total grain thickness distribution is not more than 20%.

11. The silver halide emulsion of claim 1, wherein the silver halide grains satisfy the following equation (3):

$$I_s \leqq 3I_t \qquad \text{equation (3)}$$

wherein $I_s$ represents an average surface iodide content of total grains and $I_c$ represents the average iodide content of total grains.

12. The silver halide emulsion of claim 1, wherein the internal region is substantially hexagonal when viewed from the direction vertical to the major faces.

13. The silver halide emulsion of claim 1, wherein the tabular grains contain at least 10 dislocation lines in the peripheral regions satisfying the following equation (4):

$$d_1 < 5(I_t)^{1/3} \qquad \text{equation (4)}$$

wherein $d_1$ represents an average length (nm) of the dislocation lines and $I_c$ represents the average iodide content of total grains.

14. The silver halide emulsion of claim 13, wherein said $d_1$ is not more than 65 nm.

15. The silver halide emulsion of claim 13, wherein said $d_1$ is not more than 25 nm.

16. The silver halide emulsion of claim 1, wherein a coefficient of variation of dislocation line length in the peripheral region among grains is not more than 40%.

17. The silver halide emulsion of claim 16, wherein said coefficient of variation of dislocation line length in the peripheral region among grains is not more than 20%.

18. The silver halide emulsion of claim 1, wherein the major faces are hexagonal and the dislocation lines are concentrated into corners of the major faces.

19. The silver halide emulsion of claim 1, wherein the tabular grains have side-faces, said-side faces having a surface iodide content of not more than 3 mol %.

20. The silver halide emulsion of claim 19, wherein a polyvalent metal compound is contained in a region of the side-faces having a surface iodide content of not more than 3 mol %.

21. The silver halide emulsion of claim 1, wherein the tabular grains have a thickness of not more than 0.20 μm and the high iodide phase is in a region external to 65% by volume of the grain in the direction of diameter or thickness.

22. The silver halide emulsion of claim 1, wherein the tabular grains contain at least 30 dislocation lines in the peripheral region.

23. The silver halide emulsion of claim 1, wherein the tabular grains satisfy the following equation (5):

$$(r/d) \leqq 1.10 \times (R/D) \quad \text{equation (5)}$$

wherein r and d are a diameter and a thickness of the internal region surrounded by the high iodide phase, respectively, and R and D are a diameter and a thickness of the tubular grain, respectively.

24. The silver halide emulsion of claim 1, wherein the tabular grains satisfy the following equation (6):

$$d \leqq 0.9D \quad \text{equation (6)}$$

wherein d is a thickness of the internal region surrounded by the high iodide phase and D is a thickness of grain thickness.

25. The silver halide emulsion of claim 1, wherein the tabular grains have side-faces, an average iodide content of the high iodide phase on the side-face side being higher that of the major face side.

26. The silver halide emulsion of claim 1, wherein the internal region contains a hole trap zone.

27. The silver halide emulsion of claim 1, wherein the silver halide grains are prepared by a process of forming the internal region by mixing a silver salt and a halide salt in a reaction vessel and then forming the high iodide phase surrounding the internal phase, and wherein the volume of a reaction solution contained in a reaction vessel is concentrated to not more than 2.5 liters per mole of silver halide contained in the reaction solution immediately before forming the high iodide phase.

28. A silver halide emulsion comprising silver halide grains wherein the silver halide grains meet the following requirement:

(a) at least 50% of total grain projected area is accounted for by tabular grains satisfying the following equation (1-1):

$$A \geqq 4(x)^{1/2} \quad \text{equation (1-1)}$$

wherein A represents an aspect ratio and x represents an average equivalent cube edge length (μm)

(b) a coefficient of variation of total grain size distribution is not more than 25%;

(c) an average iodide content of total grains is not more than 4 mol; and (d) the tabular grains each have major faces and contain dislocation lines in the peripheral region of the major face, and the tabular grains comprising a high iodide phase which is internal to and along the dislocation lines and an internal region surrounded by the high iodide phase, the internal region being comprised of substantially homogeneous silver halide phase and having an average iodide content of not more than 1 mol %.

29. The silver halide emulsion of claim 28, wherein a coefficient of variation of total grain thickness distribution is not more than 40%.

30. The silver halide emulsion of claim 28, wherein a coefficient of variation of total grain thickness distribution is not more than 20%.

31. The silver halide emulsion of claim 28, wherein the silver halide grains satisfy the following equation (2):

$$I_t \leqq 1.8/x \quad \text{equation (2)}$$

wherein $I_t$ represents the average iodide content of the grains and x represents an average equivalent cube edge length (μm).

32. The silver halide emulsion of claim 28, wherein the silver halide grains satisfy the following equation (3):

$$I_s \leqq 3I_t \quad \text{equation (3)}$$

wherein $I_s$ represents an average surface iodide content of total grains and $I_t$ represents the average iodide content of total grains.

33. The silver halide emulsion of claim 29, wherein the internal region is substantially hexagonal when viewed from the direction vertical to the major faces.

34. The silver halide emulsion of claim 28, wherein the tabular grains contain at least 10 dislocation lines in the peripheral region, satisfying the following equation (4):

$$d_1 < 5(I_t)^{1/3} \quad \text{equation (4)}$$

wherein $d_1$ represents an average length (nm) of the dislocation lines and $I_t$ represents the average iodide content of total grains.

35. The silver halide emulsion of claim 34, wherein said $d_1$ is not more than 65 nm.

36. The silver halide emulsion of claim 34, wherein said $d_1$ is not more than 25 nm.

37. The silver halide emulsion of claim 28, wherein a coefficient of variation of dislocation line length in the peripheral region among grains is not more than 40%.

38. The silver halide emulsion of claim 37, wherein said coefficient of variation of dislocation line length in the peripheral region among grains is not more than 20%.

39. The silver halide emulsion of claim 28, wherein the major faces are hexagonal and the dislocation lines are concentrated into corners of the major faces.

40. The silver halide emulsion of claim 28, wherein the tabular grains have side-faces, said side-faces having a surface iodide content of not more than 3 mol %.

41. The silver halide emulsion of claim 40, wherein a polyvalent metal compound is contained in a region of the side-faces having a surface iodide content of not more than 3 mol %.

42. The silver halide emulsion of claim 28, wherein the tabular grains have a thickness of not more than 0.20 μm and the high iodide phase is in a region external to 65% by volume of the grain in the direction of diameter or thickness.

43. The silver halide emulsion of claim 28, wherein the tabular grains contain at least 30 dislocation lines in the peripheral region.

44. The silver halide emulsion of claim 28, wherein the tabular grains satisfy the following equation (5):

$$(r/d) \leqq 1.10 \times (R/D) \quad \text{equation (5)}$$

wherein r and d are a diameter and a thickness of the internal region surrounded by the high iodide phase, respectively, and R and D are a diameter and a thickness of the tabular grain, respectively.

45. The silver halide emulsion of claim 28, wherein the tabular grains satisfy the following equation (6):

$$d \geqq 0.9D \quad \text{equation (6)}$$

wherein d is a thickness of the internal region surrounded by the high iodide phase and D is a thickness of grain thickness.

46. The silver halide emulsion of claim 28, wherein the tabular grains have side-faces, an average iodide content of the high iodide phase on the side-face side being higher that of the major face side.

47. The silver halide emulsion of claim 28, wherein the internal region contains a hole trap zone.

48. The silver halide emulsion of claim 28, wherein the silver halide grains are prepared by a process of forming the internal region by mixing a silver salt and a halide salt in a reaction vessel and then forming the high iodide phase surrounding the internal phase, and wherein the volume of a reaction solution contained in a reaction vessel is concentrated to not more than 2.5 liters per mole of silver halide contained in the reaction solution immediately before forming the high iodide phase.

49. A silver halide photographic material comprising a support having thereon at least one light sensitive layer wherein the light sensitive layer comprises a silver halide emulsion as claimed in claim 1.

50. The photographic material of claim 49, wherein the light sensitive layer further comprises a magenta coupler represented by the following formula (M-A) or (M-B):

formula (M-A)

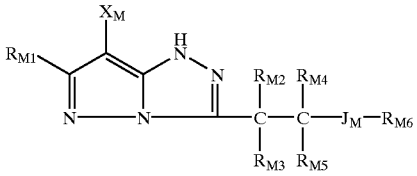

formula (M-B)

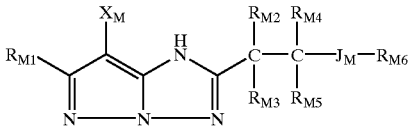

wherein $R_{M1}$ is a hydrogen atom or a substituent; $R_{M2}$ and $R_{M3}$ are each an alkyl group; $R_{M4}$ and $R_{M5}$ are a hydrogen atom or an alkyl group; $J_M$ is —OOC—, —$NR_{M7}$CO— or —$NR_{M7}$SO2—, in which $R_{M7}$ is a hydrogen atom or an alkyl group; $R_{M6}$ an alkyl group, aryl group, alkoxy group, aryloxy group, alkylamino group or arylamino group; $X_M$ a hydrogen atom, a halogen atom or a group capable of being released upon reaction with an oxidation product of a color developing agent.

51. A silver halide photographic material comprising a support having thereon at least one light sensitive layer wherein the light sensitive layer comprises a silver halide emulsion as claimed in claim 28.

52. The photographic material of claim 51, wherein the light sensitive layer further comprises a magenta coupler represented by the following formula (M-A) or (M-B):

formula (M-A)

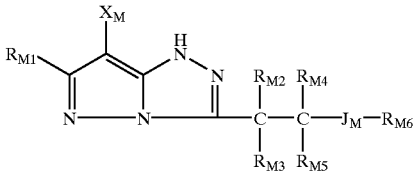

-continued formula (M-B)

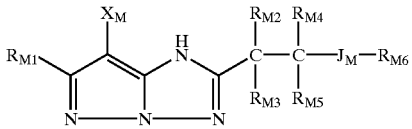

wherein $R_{M2}$ is a hydrogen atom or a substituent; $R_{M2}$ and $R_{M3}$ are each an alkyl group; $R_{M4}$ and $R_{M5}$ are each a hydrogen atom or an alkyl group; $J_M$ is —OOC—, —$NR_{M7}$CO— or —$NR_{M7}SO_2$—, in which $R_{M7}$ is a hydrogen atom or an alkyl group; $R_{M6}$ is an alkyl group, aryl group, alkoxy group, aryloxy group, alkylamino group or arylamino group; $X_M$ is a hydrogen atom, a halogen atom or a group capable of being released upon reaction with an oxidation product of a color developing agent.

53. A silver halide color reversal photographic material comprising a support having thereon at least one light-sensitive layer wherein the light sensitive layer comprises a silver halide emulsion as claimed in claim 1.

54. The photographic material of claim 53, wherein the light sensitive layer further comprises a magenta coupler represented by the following formula (M-A) or (M-B):

formula (M-A)

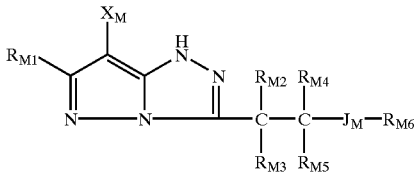

formula (M-B)

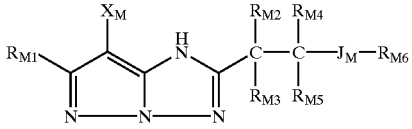

wherein $R_{M1}$ is a hydrogen atom or a substituent; $R_{M2}$ and $R_{M3}$ are each an alkyl group; $R_{M4}$ and $R_{M5}$ are each a hydrogen atom or an alkyl group; $J_M$ is —OOC—, —$NR_{M7}$CO— or —$NR_{M7}SO_2$—, in which $R_{M7}$ is a hydrogen atom or an alkyl group; $R_{M6}$ an alkyl group, aryl group, alkoxy group, aryloxy group, alkylamino group or arylamino group; $X_M$ is a hydrogen atom, a halogen atom or a group capable of being released upon reaction with an oxidation product of a color developing agent.

55. A silver halide color reversal photographic material comprising a support having thereon at least one light-sensitive layer wherein the light sensitive layer comprises a silver halide emulsion as claimed in claim 28.

56. The photographic material of claim 55, wherein the light sensitive layer further comprises a magenta coupler represented by the following formula (M-A) or (M-B):

formula (M-A)

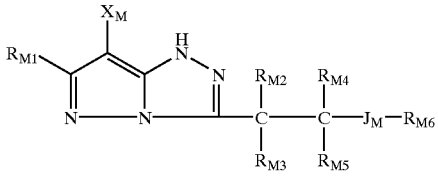

-continued formula (M-B)

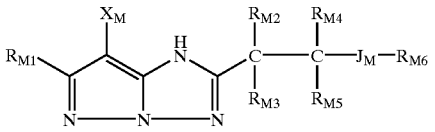

wherein $R_{M1}$ is a hydrogen atom on a substituent; $R_{M2}$ and $R_{M3}$ are each an alkyl group; $R_{M4}$ and $R_{M5}$ are each a hydrogen atom or an alkyl group; $J_M$ is —OOC—, —$NR_{M7}CO$— or —$NR_{M7}SO_2$—, in which $R_{M7}$ is a hydrogen atom or an alkyl group; $R_{M6}$ is an alkyl group, aryl group, alkoxy group, aryloxy group, alkylamino group or arylamino group; $X_M$ is a hydrogen atom, a halogen atom or a group capable of being released upon reaction with an oxidation product of a color developing agent.

* * * * *